US006763219B2

(12) United States Patent
Kobayashi et al.

(10) Patent No.: US 6,763,219 B2
(45) Date of Patent: Jul. 13, 2004

(54) IMAGE FORMING APPARATUS AND CUT SHEET CONVEYANCE CONTROL METHOD

(75) Inventors: Hiroshi Kobayashi, Kawasaki (JP); Tomoyuki Nagamine, Kawasaki (JP); Hidefumi Tasaki, Kawasaki (JP); Katsumi Takada, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 4 days.

(21) Appl. No.: 10/028,369

(22) Filed: Dec. 28, 2001

(65) Prior Publication Data

US 2003/0020228 A1 Jan. 30, 2003

(30) Foreign Application Priority Data

Jul. 30, 2001 (JP) ..... 2001-229597

(51) Int. Cl.[7] ..... G03G 15/00; G03G 15/20

(52) U.S. Cl. ..... 399/401; 399/325

(58) Field of Search ..... 399/67, 68, 324, 399/325, 401, 388, 394, 298, 302, 321, 122

(56) References Cited

U.S. PATENT DOCUMENTS 5,897,244 A * 4/1999 Miyazaki et al. ..... 399/122
6,173,136 B1 * 1/2001 Fuchiwaki et al. ..... 399/67
6,219,520 B1 * 4/2001 Ehara ..... 399/325

FOREIGN PATENT DOCUMENTS

| | | | |
|---|---|---|---|
| JP | 05-100596 A | | 4/1993 |
| JP | 06-019255 A | | 1/1994 |
| JP | 06-149106 A | | 5/1994 |
| JP | 06-175457 A | | 6/1994 |
| JP | 7-271134 A | * | 10/1995 |
| JP | 8-234606 A | * | 9/1996 |
| JP | 09-171315 A | | 6/1997 |

* cited by examiner

*Primary Examiner*—Sophia S. Chen
(74) *Attorney, Agent, or Firm*—Armstrong, Kratz, Quintos, Hanson & Brooks, LLP

(57) ABSTRACT

A fixing device comprises an upper heat roller and a lower heat roller which, by contact rotations of their roller surfaces, thermally fix images on cut sheets passing therebetween. The fixing device further comprises a single oil roller which supplies oil for cut sheet release to the upper and lower heat rollers. When conveying to a process unit a cut sheet B1 to be back-side printed which has been delivered via a circulation path, a conveyance control unit forms a conveyance spacing L2 from a precedent cut sheet A5, which spacing conforms to one turn or more of the lower heat roller, so as to ensure uniform application of oil from the upper heat roller to the lower heat roller during the cut sheet vacant interval.

14 Claims, 21 Drawing Sheets

IMAGE FORMING APPARATUS AND CUT SHEET CONVEYANCE CONTROL METHOD

BACKGROUND OF THE INVENTION

1. Field of the Invention

The present invention relates generally to an image forming apparatus and a cut sheet conveyance control method capable of double-side printing using a color electrophotographic process, and more particularly to an image forming apparatus and a cut sheet conveyance control method for preventing a paper jam which may possibly occur upon fixation of back-side print following the front-side print.

2. Description of the Related Arts

With recent prevalence of color printers employing the electrophotographic process, demands are increasing for rapider printing operations, improved accuracies, diversified medium specifications, multi-functionality such as double-side printing, reduced size and lowered price. Among them, in the color image double-side printing, a cut sheet picked up from a cut sheet feed unit such as a cut sheet feed cassette is conveyed to a process unit for transfer of color images onto the cut sheet front side, which is then fixed by a fixing device for front-side color print and delivered to a cut sheet discharge path for standby. Then the cut sheet standing by on the cut sheet discharge path is switched back to a circulation path provided for the back-side printing and is reconveyed from the circulation path to the process unit for transfer of color images onto the cut sheet back side, after which it is fixed by the fixing device for back-side printing. The double-side printed cut sheet is finally discharged from the cut sheet discharge path into a stacker. The fixing device of such a color printer applies heat to the upper and lower heat rollers above and below the fixing device for rapid printing so that toners and cut sheets are simultaneously heated under pressure by the upper and lower heat rollers to thereby improve the fixing properties.

In the fixing device of the color electrophotographic printing machine, however, the paper jam upon the double-side printing will be attributed to the defective cut sheet releases from the heat rollers. In case of the color printing in particular, the cut sheet release property is originally poor as compared with the monochrome printing since the color prints require volumes of toners due to the overlapping transfer of different color toners, with the heat rollers being set to a higher temperature than the monochrome printer, and with the pressure nipping the cut sheet between the upper and lower heat rollers being higher than that of the monochrome printer so that the toners are thereafter fully melted by the fixing device for color development. Furthermore, in case of the double-side printing, upon the back-side print after the front-side print, the printed cut sheet front side having color images formed thereon is reheated and melted by the lower heat roller, resulting in a further impaired release property. Thus, the color printer for the double-side printing inevitably necessitates a supply of oil to the upper and lower heat rollers of the fixing device in order to improve the cut sheet release property to thereby obviate the possible paper jam. For this reason, different oil supply stations have separately been provided so far on the upper and lower heat rollers to supply oil over the roller surfaces upon the double-side printing. The oil supply stations include their respective oil-impregnated oil rollers provided correspondingly to the upper and lower heat rollers.

In the event of provision of the separate oil supply stations on the conventional upper and lower heat rollers, the separate oil rollers mounted on the upper and lower heat rollers may induce a complex, bulky and costly fixing device structure. The oil rollers are expendable supplies and need to be replaced with new ones when the number of prints reaches a predetermined service life count. However, the oil rollers impregnated with the same amount of oil may have different oil supply amounts, with the result that both the oil rollers have to be replaced with new ones for service life management when a paper jam occurs due to the insufficient oil residue of the oil roller on one hand, in spite of sufficient oil residue of the oil roller on the other. In addition, the upper and lower heat rollers of the fixing device are disposed above and below the cut sheet conveyance path to be nipped therebetween, so that the upper heat roller must be removed for the replacement of the oil roller mounted on the lower heat roller, which results in a complex structure for oil roller replacement and in a labor and time-consuming oil roller replacement work.

SUMMARY OF THE INVENTION

It is therefore the object of present invention to provide an image forming apparatus ensuring a stable supply of oil from a single oil supply station onto surfaces of upper and lower heat rollers of a fixing device to thereby prevent any possible paper jam upon the double-side color printing.

According to a first aspect of the present invention there is provided an image forming apparatus such as a color printer, capable of double-side printing, comprising a conveyance control unit which allows a cut sheet picked up from a cut sheet feed unit to be conveyed to a process unit for transfer of color images on a front side of the cut sheet, the front-side transferred color images being fixed by a fixing device, the cut sheet switched back to a circulation path after fixing being reconveyed to the process unit for transfer of color images on a back side of the cut sheet, after which the back-side transferred color images are fixed by the fixing device for discharge. In such an image forming apparatus capable of double-side printing of the present invention, the fixing device includes an upper heat roller and a lower heat roller which thermally fix images under pressure on a cut sheet passing therebetween, either the upper heat roller or the lower heat roller being provided with a single oil applicator which supply oil for cut sheet release. When conveying to the process unit a cut sheet B1 to be back-side printed delivered via the circulation path, the conveyance control unit forms a conveyance spacing between the cut sheet B1 to be back-side printed and a precedent cut sheet A5, the conveyance spacing conforming to one turn or more of the heat roller which is not provided with the oil applicator. In this manner, according to the present invention, when performing a back-side printing, after circulation, of the front-side printed cut sheets, the cut sheet conveyance is made with spacing between the adjacent cut sheets which conforms to at least one turn of the lower heat roller, so that the upper and lower heat rollers can run idle between the adjacent cut sheets, during which oil applied over the upper heat roller surface is applied over the entire periphery. For this reason, whenever the back-side transferred cut sheet enters the contact (nip) between the upper and lower heat rollers, oil is already uniformly applied over the upper and lower heat roller surfaces, thus securely preventing any possible paper jam attributable to the insufficient supply of oil to the lower heat roller. The fixing device is so structured as to allow oil impregnated into the oil roller to stably and evenly be supplied from the upper heat roller through the roller contact to the entire periphery of the lower heat roller. Thus, an extremely simple structure will suffice similar to that for the single-side printing, achieving a reduction in size and price of the fixing device for use in the double-side printing.

Herein, when the number of cut sheets i to be double-side printed is not more than the number of circulated cut sheets n which depends on the paper size and which is the maximum number of cut sheets permitted to lie on the conveyance path in the course of printing, the conveyance control unit provides a conveyance control to effect a continuous printing of back sides of cut sheets, following a continuous printing of front sides of cut sheets.

In case the number of cut sheets i to be double-side printed exceeds the number of circulated cut sheets n which depends on the paper size, the conveyance control unit provides:

I. a conveyance control to effect a continuous printing of the front-sides of the cut sheets till the n-th cut sheet of i cut sheets;

II. a conveyance control to alternate the back-side printing of (i−n)th cut sheet and the front-side printing of i-th cut sheet until the number of cut sheets i exceeds n and the number of remaining cut sheets reaches n; and III. when the number of circulated cut sheets is last n, a conveyance control to effect a continuous back-side printing of the remaining cut sheets. The number of circulated cut sheets n is e.g., 4 for paper size A4. The number of circulated cut sheets n is e.g., 2 for paper size A3. The conveyance control unit provides a drive control of a registration roller which temporarily stops a cut sheet to be conveyed to the process unit, for skew correction, to thereby form a conveyance spacing between a cut sheet to be back-side printed and a precedent cut sheet, the conveyance spacing conforming to one turn or more of the lower heat roller. The conveyance control unit provides a drive control of a registration roller which temporarily stops a cut sheet to be conveyed to the process unit, for skew correction, to thereby form a conveyance spacing L1 between a cut sheet A5 to be front-side printed and a precedent cut sheet A4, the conveyance spacing L1 being shorter than the spacing which conforms to one turn or more of the lower heat roller. The fixing device comprises a fixing device body which encloses the upper heat roller and the lower heat roller; and an oil roller unit which encloses the oil roller, the oil roller unit being mountable on and dismountable from the fixing device body. The fixing device body includes a donor roller which intervenes between the oil roller and the upper heat roller, and the oil roller unit includes a cleaning roller which cleans the donor roller.

According to a second aspect of the present invention there is provided a cut sheet conveyance control method in which a cut sheet picked up from a cut sheet feed tray is conveyed to a process unit for transfer of color images on a front side of the cut sheet, the front-side transferred color images being fixed by a fixing device which includes an upper heat roller and a lower heat roller, the cut sheet switched back to a circulation path after fixing being reconveyed to the process unit for transfer of color images on a back side of the cut sheet, after which the back-side transferred color images are fixed by the fixing device for discharge. The cut sheet conveyance control method comprises the step of, when conveying to the process unit a cut sheet A4 to be back-side printed delivered via the circulation path, forming a conveyance spacing L2 between the cut sheet A4 to be back-side printed and a precedent cut sheet A5, the conveyance spacing L2 conforming to one turn or more of the oil-applicator-free heat roller of the fixing device. In case the number of cut sheets i to be double-side printed is not more than the predetermined number of circulated cut sheets n which depends on the paper size and which is the maximum number of cut sheets permitted to lie on the conveyance path in the course of printing, a conveyance control is provided to effect a continuous printing of back sides of cut sheets, following a continuous printing of front sides of cut sheets. In case the number of cut sheets i to be double-side printed exceeds the number of circulated cut sheets n which depends on the paper size, control includes:

I. a conveyance control to effect a continuous printing of the front-sides of the cut sheets till the n-th cut sheet of i cut sheets;

II. a conveyance control to alternate the back-side printing of (i−n)th cut sheet and the front-side printing of i-th cut sheet until the number of cut sheets i exceeds n and the number of remaining cut sheets reaches n; and III. a conveyance control to effect, when the number of circulated cut sheets is last n, a continuous back-side printing of the remaining cut sheets.

The number of circulated cut sheets n is e.g., 4 for paper size A4. The number of circulated cut sheets n is e.g., 2 for paper size A3. The cut sheet conveyance method includes forming a conveyance spacing L2 between a cut sheet to be back-side printed and a precedent cut sheet, the conveyance spacing L2 conforming to one turn or more of the lower heat roller, through a drive control of a registration roller which temporarily stops a cut sheet to be conveyed to the process unit, for skew correction. The cut sheet conveyance method may include forming a conveyance spacing L1 between a cut sheet to be front-side printed and a precedent cut sheet, the conveyance spacing L1 being shorter than the spacing which conforms to one turn or more of the lower heat roller, through a registration roller which temporarily stops a cut sheet to be conveyed to the process unit, for skew correction.

The above and other objects, aspects, features and advantages of the present invention will become more apparent from the following detailed description when taken in conjunction with the accompanying drawings.

DETAILED DESCRIPTION OF THE PREFERRED EMBODIMENT

Figure 1:
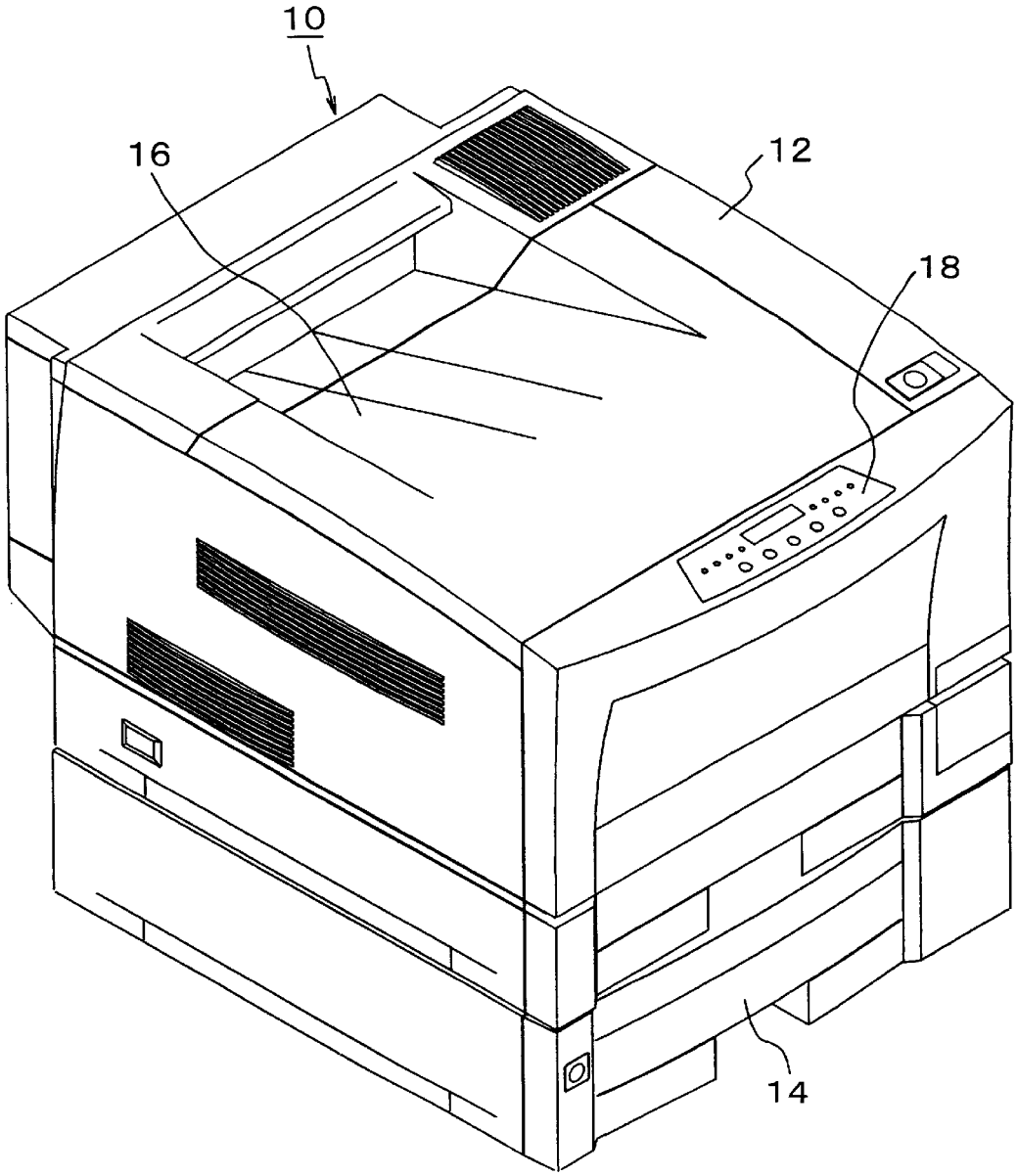
FIG. 1 is an explanatory diagram of a color printer to which the present invention is applied.

FIG. 1 is an explanatory diagram of the external appearance of a color printer to which are applied an image forming apparatus and a conveyance control method in accordance with the present invention. The color printer generally designated at 10 is removably provided with a cut sheet feed cassette 14 at the bottom of a body 12 closer to a viewer, and in this embodiment, is capable of performing single-side or double-side prints on A4 or A3 cut sheet used. A stacker 16 is formed at the upper portion of the body 12 so that printed cut sheets are discharged herein. The top of the body 12 on the cut sheet feed cassette 14 side closer to the viewer is provided with an operation panel 18 so as to allow the operator upon the printing to set the paper size, single-side print or double-side print, and the number of prints and press a start button for start of the printing operation. The color printer 10 is capable of connection to a network such as LAN and receives a print command and data from the host such as a personal computer connected to the network, to perform the printing operation by setting the printing conditions in conformity with the command.

Figure 2:
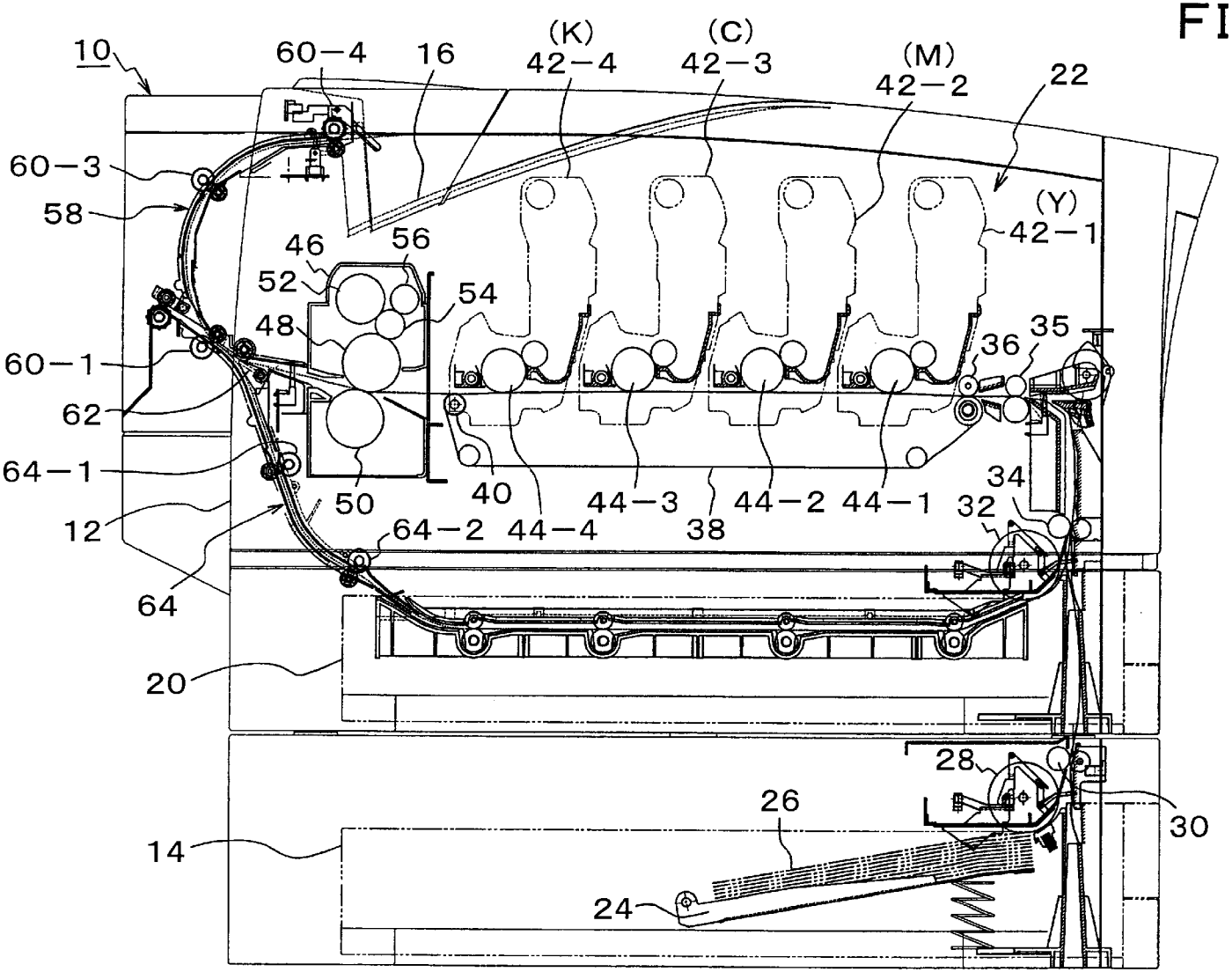
FIG. 2 is an explanatory diagram of the internal structure of the printer of FIG. 1.

FIG. 2 shows the internal structure of the color printer 10 of FIG. 1. In the color printer 10, the body 12 receives at its lower portion the cut sheet feed cassette 14 acting as a cut sheet feed unit. A double-side unit 20 is disposed above the cut sheet feed cassette 14 to form a part of a circulation path 64 for double-side printing. Paper 26 is disposed on a tray 24 within the cut sheet feed cassette 14 so that it is picked up by a second pickup roller 28 and a second feed roller 30 for feed into a registration roller 35 arranged above. The cut sheets extracted from the cut sheet feed cassette 14 are temporarily stopped at the registration roller 35 for skew correction. If preceding cut sheets exist at that time, then the next cut sheet is fed to an electrophotographic process mechanism 22 at a predetermined interval L1, e.g., L1=57 mm in this embodiment for the single-side print. The electrophotographic process mechanism 22 includes a process unit 42-1 for yellow (Y), a process unit 42-2 for magenta (M), a process unit 42-3 for cyan (C) and a process unit 43-4 for black (K) which are arranged in tandem along a conveyance belt 38. The conveyance belt 38 is rotated at a constant conveyance speed by a belt drive roller. A belt charge roller 36 is provided at the cut sheet feed side of the conveyance belt 38 so that the cut sheets fed from the registration roller 35 electrostatically stick onto the belt surface of the conveyance belt 38. The four process units 42-1 to 42-4 making up the electrophotographic process mechanism 22 are provided with their respective photosensitive drums 44-1 to 44-4 acting as image carriers and form latent images on the drum surface by optical exposures based on the image data for each color. Thereafter, a development roller forms toner images by supply of each color toner so that the toner images are overlapping transferred in sequence of color toners, yellow (Y), magenta (M), cyan (C) and black (K), arbitrarily combined in conformity with the finally required image color, on the cut sheets fed by the conveyance belt 38. Although schematic structures of the process units 42-1 to 42-4 are shown, the actual process units are arranged to have an electrifier, an LED array, and a developing device with a toner cartridge which are disposed around the photosensitive drums 44-1 to 44-4, with a cleaning blade and an eliminator disposed anterior to the electrifier. The electrophotographic process mechanism 22 is followed by a fixing device 46. The fixing device 46 comprises an upper heat roller 48, a lower heat roller 50, an oil roller 52, a donor roller 54 and a cleaning roller 56.

Figure 3:
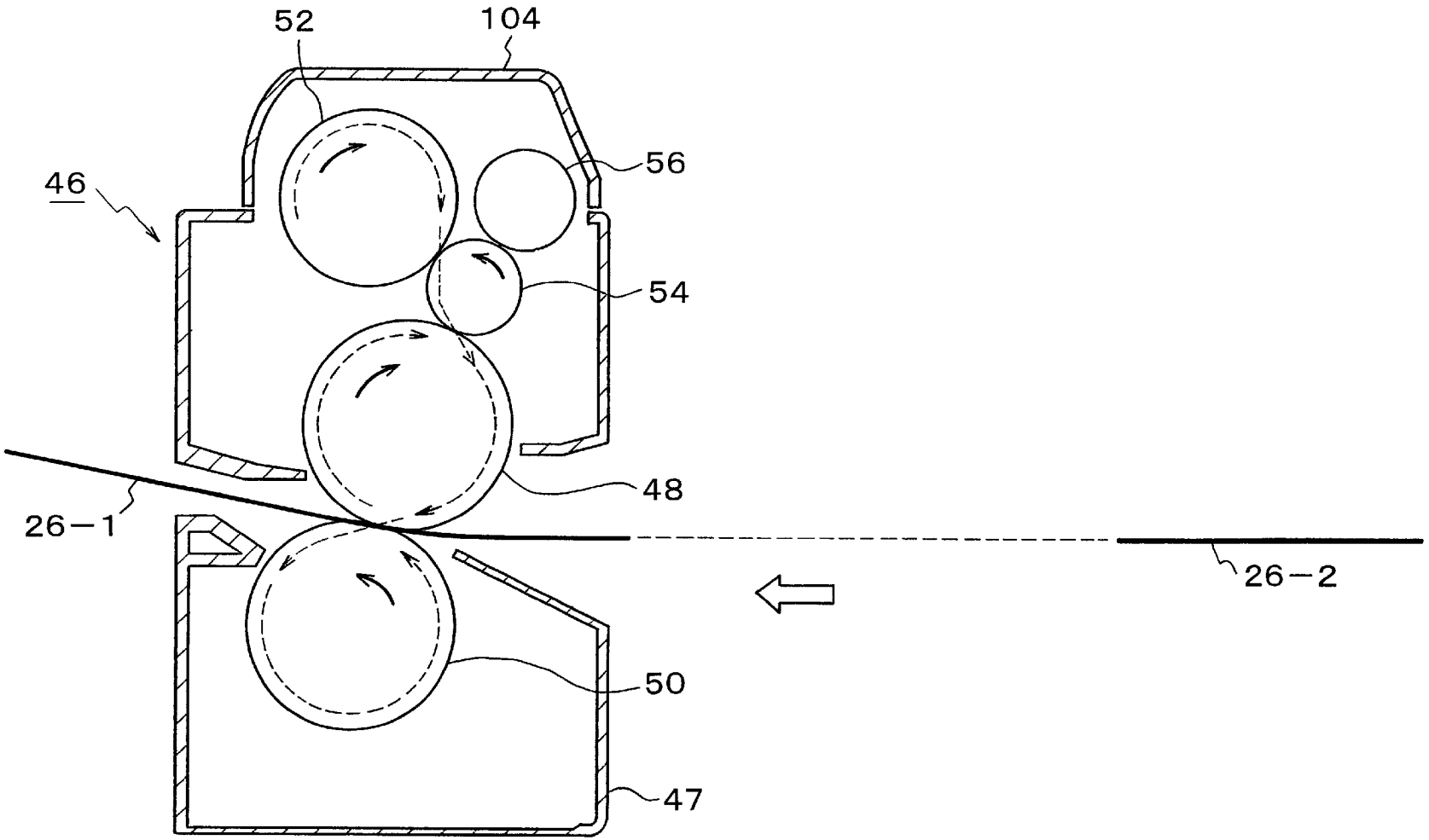
FIG. 3 is an explanatory diagram of the structure of a fixing device of FIG. 2.
Figure 6A:
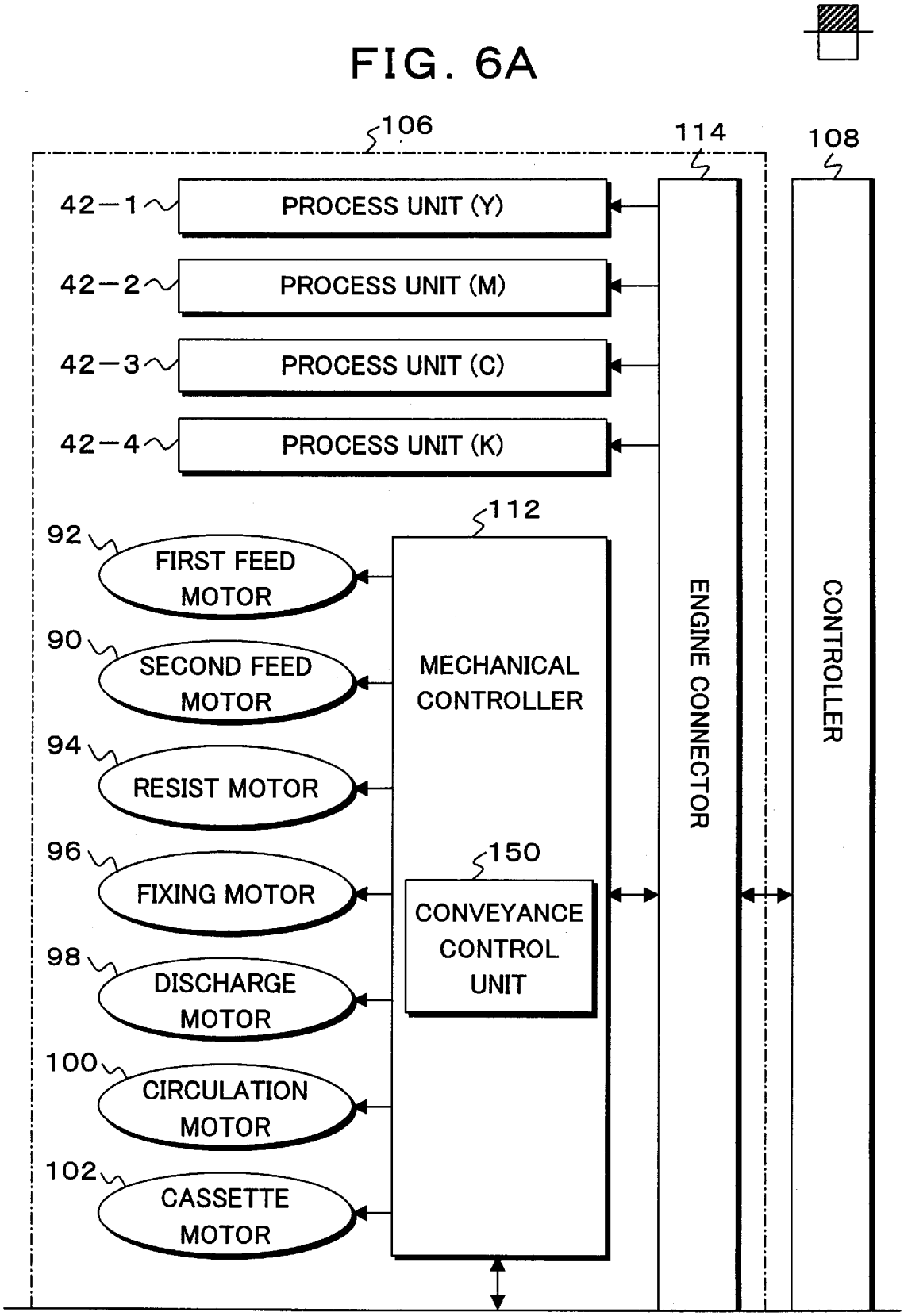
FIGS. 6A and 6B are block diagrams of a control mechanism incorporated in the printer of FIG. 2.
Figure 6B:
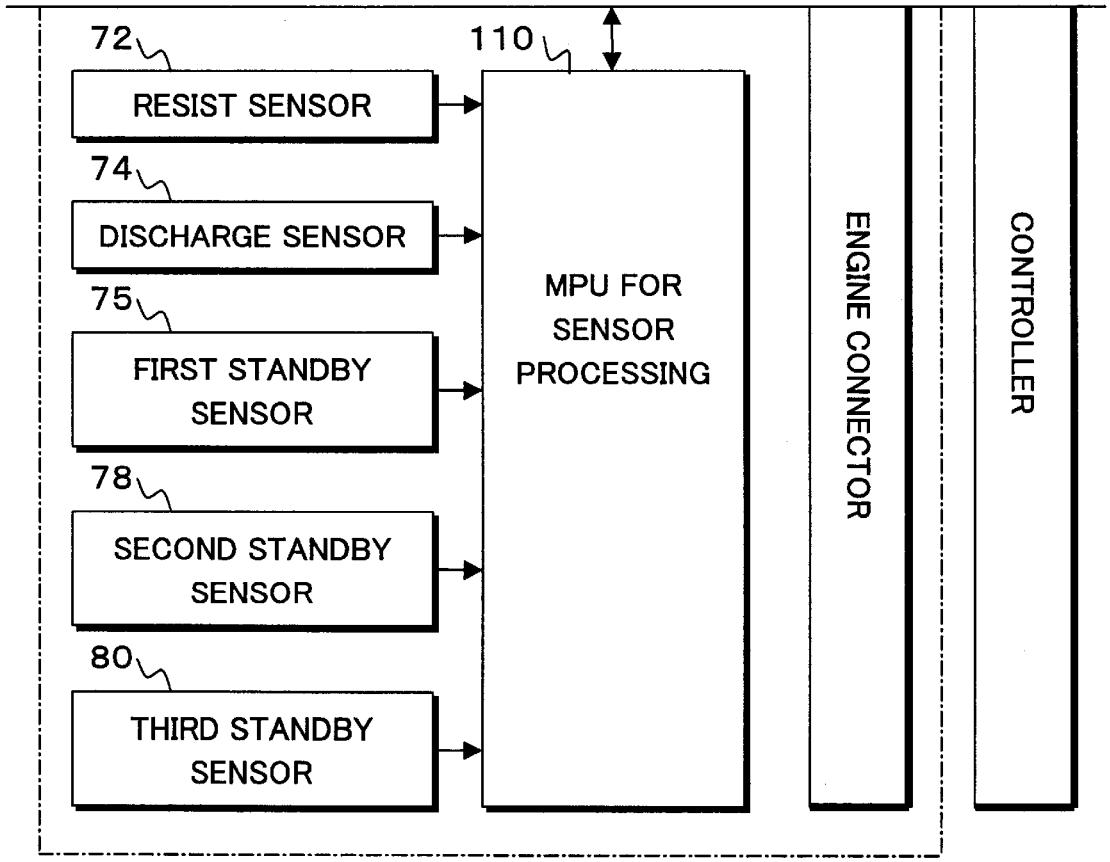

FIG. 3 illustrates the structure of the fixing device 46 of FIGS. 6A and 6B in an exclusive manner. The fixing device 46 includes a fixing device body 47 which accommodates the upper heat roller 48 and the lower heat roller 50 with a conveyance path, along which the cut sheets travel, clamped therebetween, the upper heat roller and the lower heat roller coming into contact at the roller surfaces. The oil roller 52 is disposed via the donor roller 54 with respect to the upper heat roller 48. The oil roller 52 provides an oil supply station which supplies oil for prevention of jamming on the upper heat roller 48 and the lower heat roller 50, attributable to the heat bonding of the printed cut sheets. More specifically, the oil roller 52 can be an oil roller 52 impregnated with oil. The oil roller 52 and the cleaning roller 56 are accommodated within an oil roller unit 104 removably provided on the upper portion of the fixing device body 47 so that when a predetermined service-life number is reached, the oil roller unit 104 can be dismounted from the fixed device body 47, to thereby achieve an integral disengagement of the oil roller 52 and the cleaning roller 56 for simple replacement with a new oil roller unit 104. Each roller of the fixing device 46 is rotated by a fixation motor not shown upon the print of cut sheets so that oil on the oil roller 52 is applied onto the toner surface of the upper heat roller 48 after application of the oil onto the roller surface of the donor roller 54. At that time, if a cut sheet 26-1 is a sheet for front side printing, the toner image is transferred onto the front side, the transferred images melting as a result of contact with the upper heat roller 48, to perform the fixation by color image coloring. Due to the uniform application of the oil over the roller surface of the upper heat roller 48, it is possible to effect an easy release without being stuck onto the drum surface irrespective of the melting of the toners by fixation. On the other hand, in cases where, subsequent to the front side print of the cut sheet 26-1, a cut sheet 26-2 is fed to the fixing device 46 after toner transfer by the back side printing, the upper heat roller 48 comes into direct contact with the lower heat roller 50 through the spacing between the preceding cut sheet 26-1 and the next cut sheet 26-2 so that oil supplied for application from the oil roller 52 to the upper heat roller 48 is uniformly applied to the roller surface of the lower heat roller 50 through the drum idle rotation as indicated by dotted line as a result of contact with the drum surface of the lower heat roller 50. In order to achieve such a uniform application of oil from the upper heat roller 48 onto the roller surface of the lower heat roller 50, the spacing for one turn of the lower heat roller 50 has only to be present between the preceding cut sheet 26-1 and the next cut sheet 26-2. Let L2 be the spacing for uniform application of oil onto the lower heat roller upon the back printing, the double-side printed cut sheet 26-2 should be transferred with the spacing equal to or more than the cut sheet passage time for one turn of the lower heat roller 50, i.e., the circumference of the roller surface of the lower heat roller 50, more specifically, L2=2πr, i.e., L2=130 mm in this embodiment, where r is the radius of the lower heat roller 50. In contrast with this, upon the single-side printing, oil from the oil roller 52 is uniformly applied via the donor roller 54 onto the upper heat roller 48, so that the cut sheet feed for front-side printing has only to be performed with the minimum spacing L1, in this embodiment L1=57 mm, required for the printing by the electrophotographic process mechanism 22.

Referring again to FIG. 2, the fixing device 46 is followed by a cut sheet discharge path 58 for discharging the cut sheets onto the stacker 16 provided on top of the body. The cut sheet discharge path 58 is provided with discharge rollers 60-1 to 60-4 which are driven by a motor. At the time of single-side printing, cut sheets having toner images fixed thereon by the fixing device are discharged through the cut sheet discharge path 58 onto the stacker 16. On the contrary, upon the double-side printing, the front-side printed cut sheets are fed to the cut sheet discharge path 58 by the forward rotations of the cut sheet discharge rollers 60-1 to 60-4, after which under the conditions that there are no preceding cut sheets on the circulation path 64, the cut sheet discharge rollers 60-1 to 60-4 are reversely rotated so that the cut sheets are fed onto the circulation path 64 while being guided by a circulation gate 62. The circulation path 64 is provided with circulation rollers 64-1 and 64-2 by means of which the cut sheets are fed to the double-side unit 20 under the conditions that the cut sheets fed from the discharge path 58 are temporarily stopped with no preceding cut sheets on the side of the double-side unit 20. The double-side unit 20 is provided with intra-double-side-unit rollers 66-1 to 66-4 by means of which the cut sheets fed from the circulation path 64 are temporality stopped at a predetermined position within the double-side unit 20. On the right side of the double-side unit 20 there are provided a first pickup roller 32 and a first feed roller 34 so as to pick up front-side printed cut sheets standing by at the double-side unit 20, to thereafter deliver them to the registration roller 35 for double-side printing.

Figure 4:
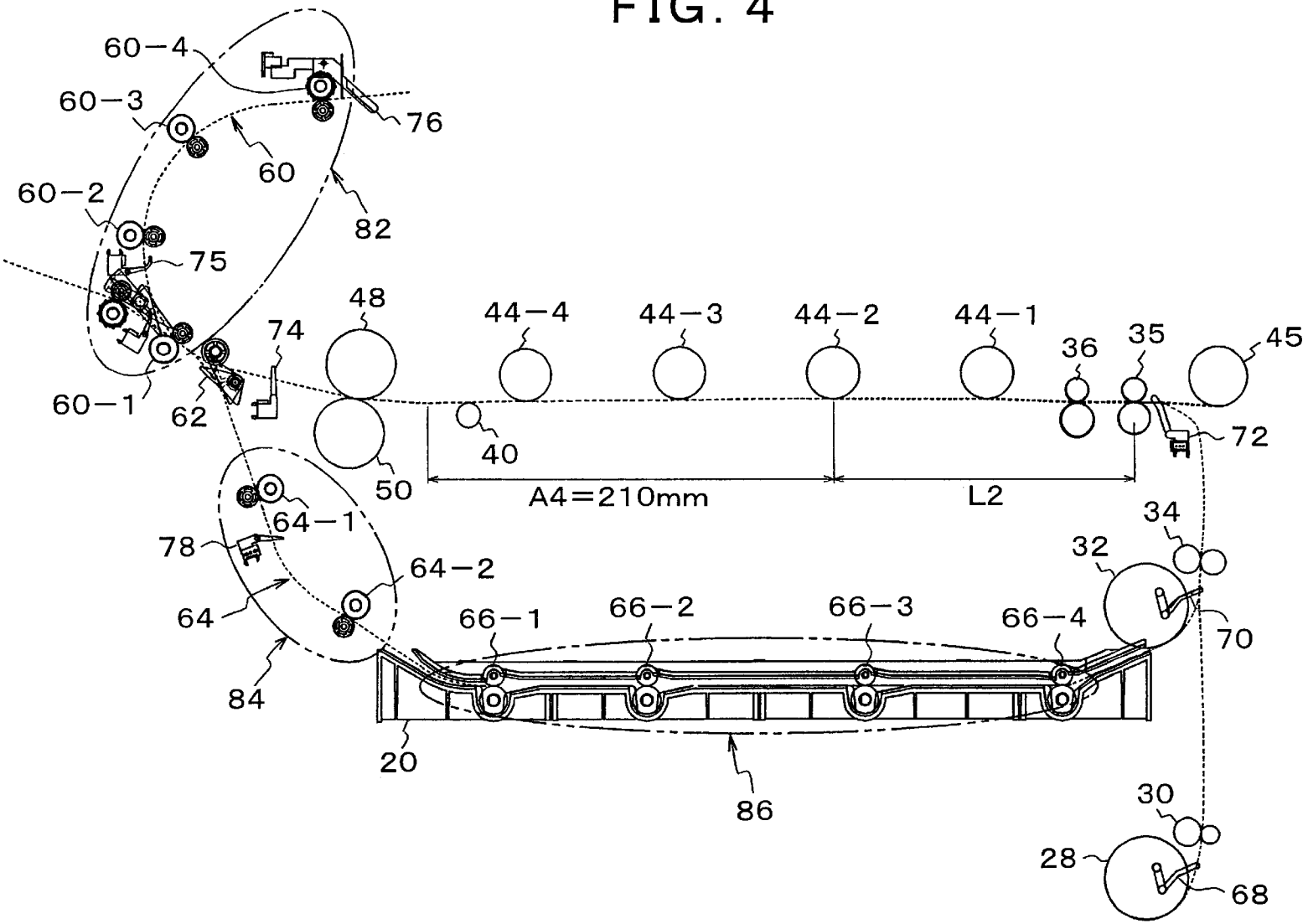
FIG. 4 is an explanatory diagram showing, in an excluded manner, a cut sheet conveyance path of FIG. 2.

FIG. 4 illustrates, together with a sensor, a cut sheet conveyance path for double-side printing provided within the color printer 10 of FIG. 2. A cut sheet feed sensor 68 is disposed in the region of a second pickup roller 28 for picking up cut sheets from the cut sheet feed cassette. A cut sheet feed sensor 70 for detecting a cut sheet from the double-side unit 20 is disposed in the region of the first pickup roller 32 following the second pickup roller 28. Then, a registration sensor 72 is disposed anterior to the registration roller 35. A pickup roller 45 for manual feed is disposed outside the registration roller 35, allowing cut sheets to internally be manually fed for printing. Then, the upper heat roller 48 and the lower heat roller 50 of the fixing device 46 are provided following the photosensitive drums 44-1 to 44-4 of the electrophotographic process mechanism, with a cut sheet sensor 74 provided at its outlet side. The region of the conveyance path containing the cut sheet discharge rollers 60-1 to 60-4 provides a first standby position 82 as indicated by encircling phantom line. A first standby sensor 75 is disposed at the first standby position 82. The front-side printed cut sheets are fed, for temporary stop, to the first standby position 82 by forward rotations of the cut sheet discharge rollers 60-1 to 60-4 and thereafter are delivered toward the circulation path 64 by the roller reverse rotations. A second standby position 84 is constituted by the region of the conveyance path of the circulation path 64 containing the circulation rollers 64-1 to 64-2 disposed posterior to the circulation gate 62. A second standby sensor 78 is disposed at the second standby position 84. A third standby position 86 is constituted by the region of the circulation path containing the intra-double-side-unit rollers 66-1 to 66-4 provided in the double-side unit 20. A third standby sensor is disposed at the third standby position 86 within the interior of the double-side unit 20. The first standby position 82, the second standby position 84 and the third standby position 86 are standby positions optimized from the length of the conveyance path when the paper size is A4. For this reason, in case the A4 cut sheets are subjected to the continuous double-side printing, the cut sheets will be present at the first standby position 82, the second standby position 84 and the third standby position 86 which are print positions from the photosensitive drum 44-1 to the photosensitive drum 44-4 which provide a conveyance path for double-side printing. The present invention defines, as the number of circulated sheets n, the maximum number of sheets allowing the existence on the conveyance path in the course of double-side printing. The number of circulated sheets n in this embodiment results in n=4 for A4 size. On the contrary, the number of circulated sheets n for A3 size results in n=3.

When the front-side printed cut sheets in standby state are picked up at the double-side unit 20 acting as the third standby position 86 by the first pickup roller 32 and the first feeder roller 34 for temporarily stop with its leading edge in registration with the registration roller 35 in FIG. 3, feed of the record sheets for double-side printing is started by activating the registration roller 35 with spacing L2 from the trailing edge of the preceding record sheet in print up to the leading edge of the cut sheet to be fed for the double-side printing, the spacing L2 being specifically 130 mm which is equal to or more than one turn of the lower heat roller 50 provided on the fixing device. Since the speed of belt conveyance by belt drive roller 40 is fixed and hence the distance is determined to be 210 mm+L2=340 mm for A4 size for instance from the leading edge of the preceding cut sheet on the registration roller 35 up to the start of the draw of the next cut sheet for double-side printing with the cut sheet spacing L2=130 mm, control for spacing L2=130 mm between the adjacent cut sheets is achieved by finding the time obtained from division of that distance by the conveyance speed and by providing a control of the drawing by the registration roller 35 so as to allow that time interval. On the contrary, in cases where the front-side printed cut sheets are temporarily stopped by the registration roller 35, cut sheet feed for the next front-side printing is performed by the registration roller 35 with a predetermined spacing L1, e.g., L1=57 mm which is required for the print by the photoelectric process mechanism and which is shorter than the spacing L2=130 mm between the adjacent cut sheets.

Figure 5:
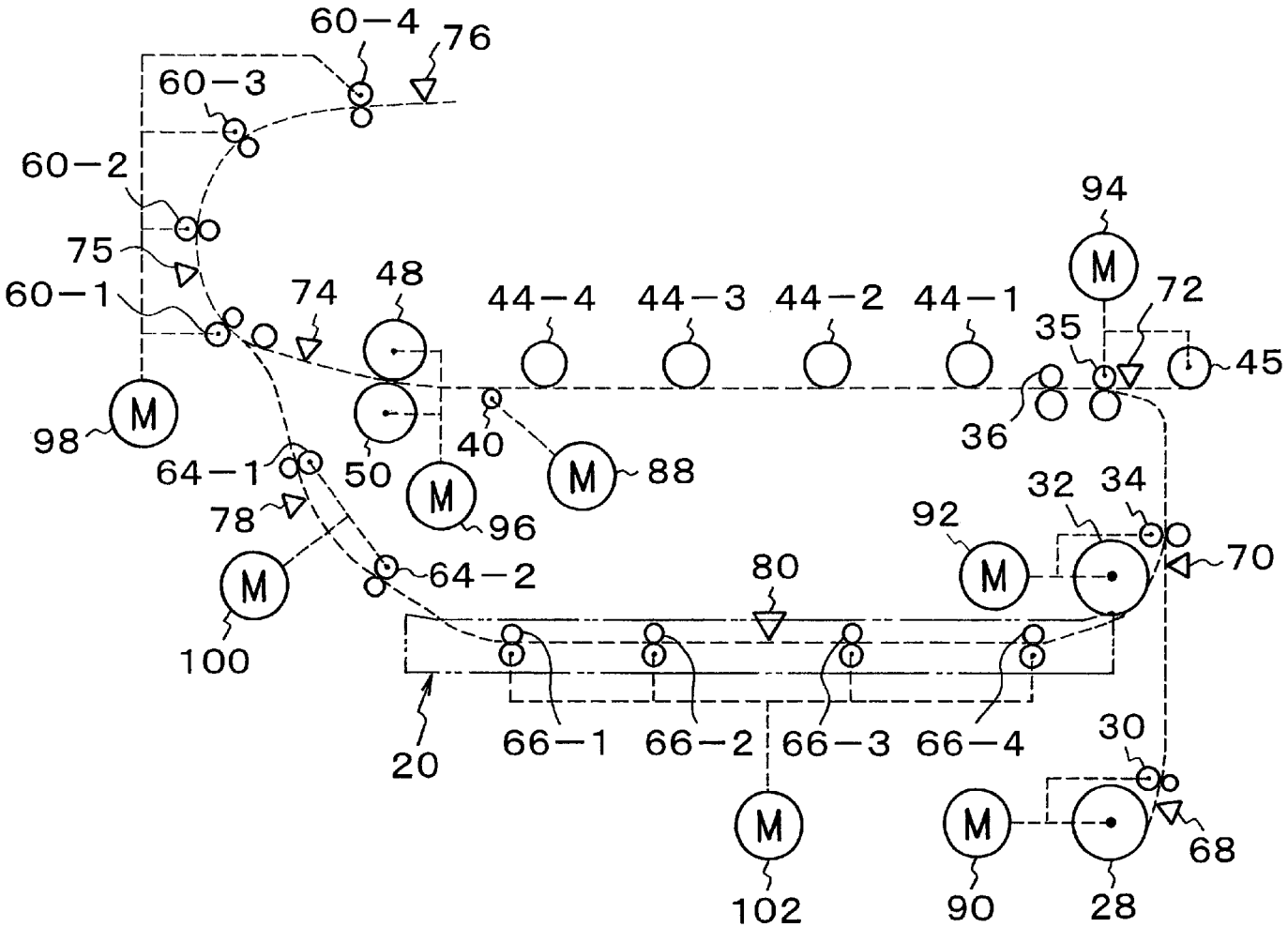
FIG. 5 is an explanatory diagram of the arrangement of motors on the cut sheet conveyance path of FIG. 4.

FIG. 5 shows the arrangement of the drive motor for the rollers disposed on the conveyance path for double-side printing of FIG. 4. The second pickup roller 28 and the second feed roller 30 are driven by a second feed motor 90. The subsequent first pickup roller 32 and the first feed roller 34 are driven by a first feed motor 92. The subsequent registration roller 35 and the pickup roller 45 for manual feed are driven by a registration motor 94. The belt drive roller 40 is driven by a belt drive motor 88. The upper heat roller 48 and the lower heat roller 50 are driven by a fixing device motor 96. The cut sheet discharge rollers 60-1 to 60-4 are driven by a cut sheet discharge motor 98. The circulation rollers 64-1 and 64-2 are driven by a circulation motor 100. The intra-double-side-unit rollers 66-1 to 66-4 provided within the double-side unit 20 are driven by a cassette motor 102. A third standby sensor 80 acting also as an intra-unit jamming detection sensor is disposed at a predetermined position within the double-side unit 20.

FIGS. 6A and 6B are block diagrams of a control mechanism incorporated in the color printer 10 of FIG. 1. The control mechanism of the color printer 10 of the present invention comprises a print engine 106 and a controller 108. The print engine 106 includes an MPU 110 for sensor processing and a mechanical controller 112. The MPU 110 for sensor processing is associated with the registration sensor 72, the cut sheet discharge sensor 74, the first standby sensor 75, the second standby sensor 78 and the third standby sensor 80. Although other various sensors required are naturally associated therewith, only the sensors required for the cut sheet conveyance control of the present invention are shown exclusively. Information on the cut sheet detection detected by the MPU 110 for sensor processing is fed to the mechanical controller 112. On the basis of print control data such as paper size, the number of prints, double-side printing or single-side printing, etc., from the controller 108, the mechanical controller 112 provides the control of the drive motors arranged on the conveyance path. To this end, the mechanical controller 112 is provided with a conveyance control unit 150 which is implemented by a program control. In parallel, the mechanical controller 12 provides a control of the drive motors for the photosensitive drums disposed in the process units 42-1 to 42-4.

The mechanical controller 112 provides a control of the first feed motor 92, the second feed motor 90, the registration motor 94, the fixing device motor 96, the cut sheet discharge motor 98, the circulation motor 100 and the cassette motor 102 which are provided correspondingly to the rollers on the conveyance path as seen FIG. 5.

Figure 7:
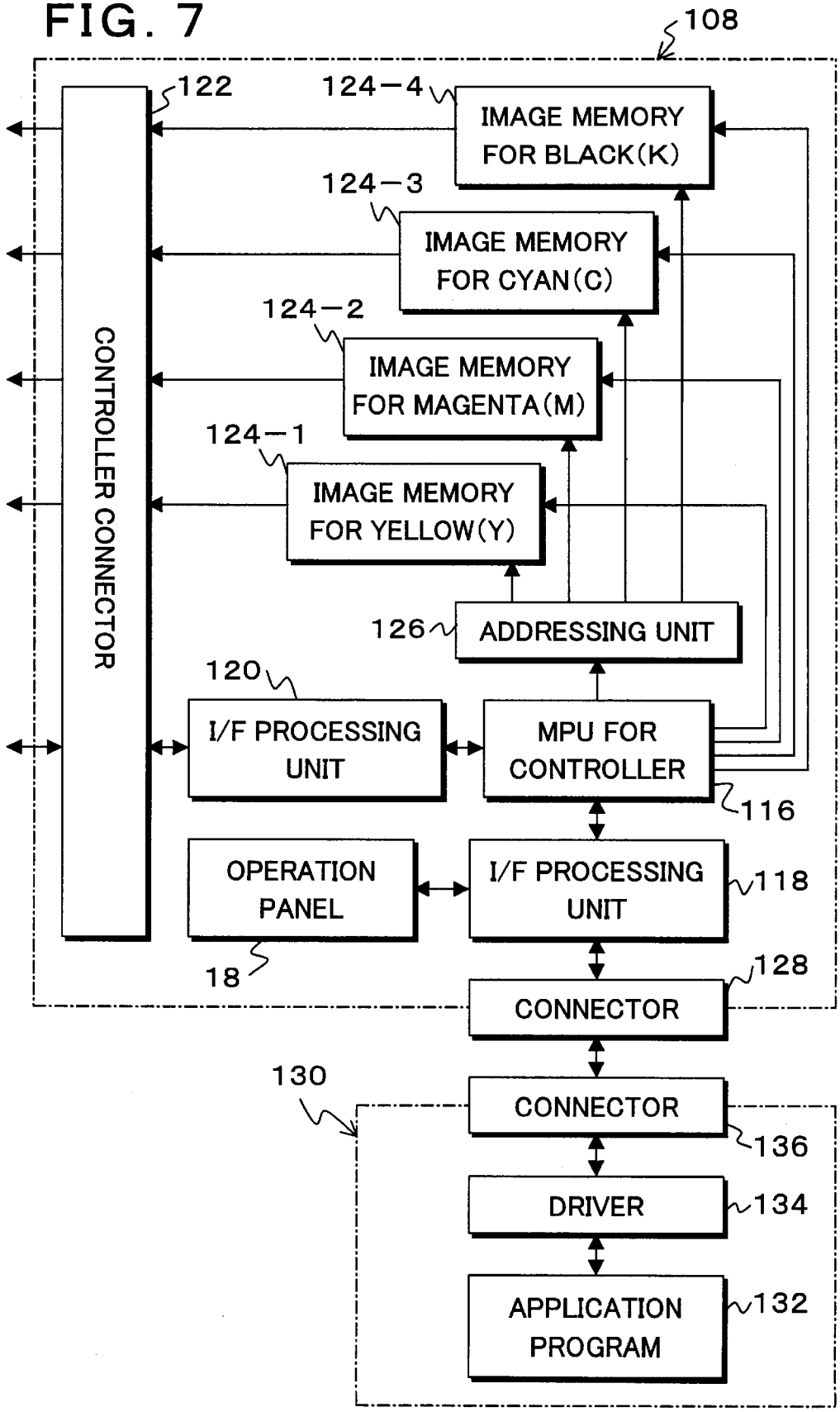
FIG. 7 is a block diagram of a controller of FIG. 6.

FIG. 7 is a block diagram of a controller 108 provided in the controller mechanism of FIGS. 6A and 6B. The controller 108 is connected via a controller connector 122 to a print engine 106 of FIG. 7 by way of its engine connector 114. The controller 108 comprises an MPU 116 for controller which is connected via an I/F processing unit 118 and a connector 128 to a personal computer 130 acting as a host. The personal computer 130 includes a driver 134 for printing color image data fed from any application program 132 and transfers a print control instruction and color image data to the MPU 116 for controller 116 by way of the connectors 136 and 128 and the I/F processing unit 118.

The MPU 116 for controller converts Y, M, C and K image data transferred from the personal computer 130 to pixel data (dot data) for storage into associated image memories 124-1 to 124-4. The MPU 116 for controller is connected via the I/F processing unit 120 and the controller connector 122 to the print engine of FIG. 7 and accepts positional offset information or toner density information for cut sheets detected by the print engine 106, to perform the color matching processing including positional offset correction or toner density correction for the respective toner image data stored into the image memories 124-1 to 124-4. The MPU 116 for controller is further associated with an addressing unit 126 to perform addressing upon the storage of respective color images into the image memories 124-1 to 124-4. The addressing unit 126 serves also to perform address conversion for corrections based on the information on actual examples provided from the print engine 106. The MPU 116 for controller is further associated via the I/F processing unit 118 with the operation panel 18 to allow the operator to perform various manual setting for print processing and to allow various displays on the liquid crystal display provided on the operation panel.

Figure 8:
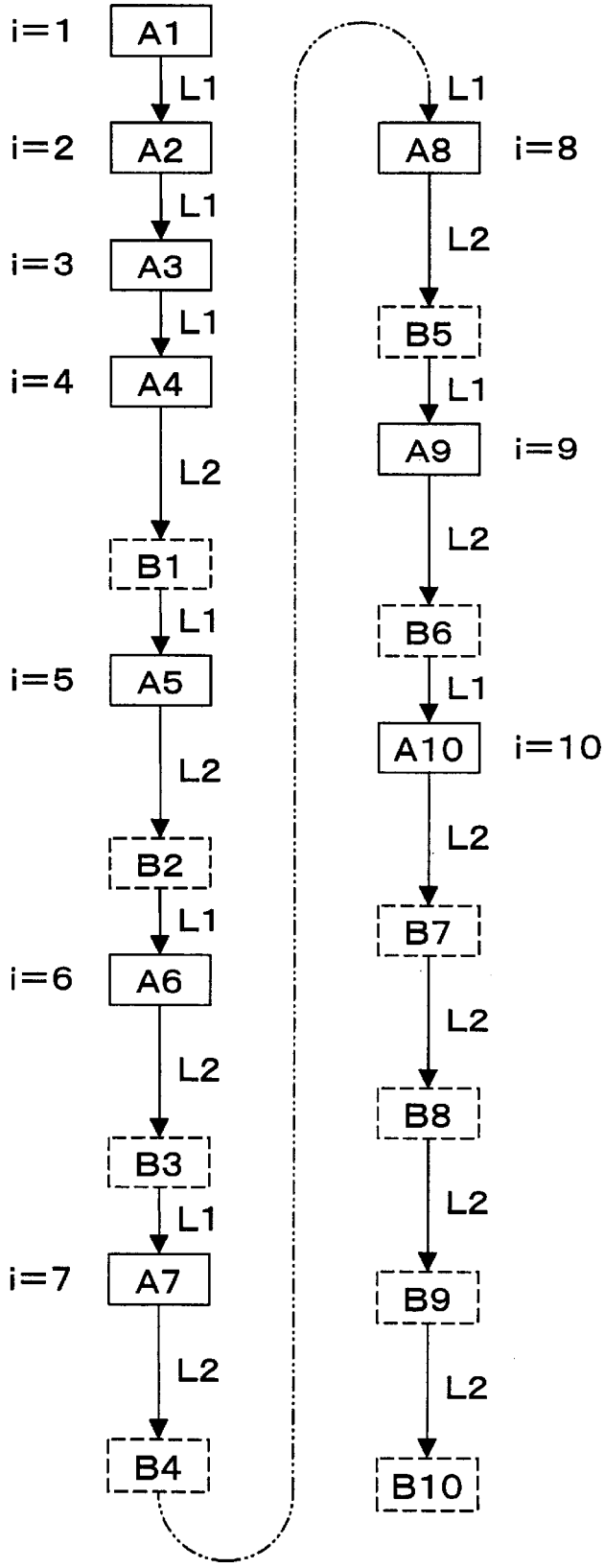
FIG. 8 is an explanatory diagram showing the order of the front-side printing and the back-side printing in case of double-side printing of 10 A4 cut sheets.

Description will then be made of the action effected when 10 A4 cut sheets are subjected to continuous double-side printing operation. FIG. 8 shows the sequence of the front side print (A side print) and the back side print (B side print) in the double-side printing of the 10 A4 cut sheets. Herein, the number of sheets i is the number of cut sheets to be picked up from the cut sheet feed cassette and ranges from 1 to 10. The solid line frames designate front side print (A side print) of the cut sheets and the front side print is represented by A1 to A10 which conform to the number of cut sheets i=1 to 10. The broken line frames designate back side print (B side print) effected using the circulation path after the front side print and the back side print is represented by B1 to B10 which conform to the number of sheet i. The number of circulated sheets n is 4 which means the number of A4 cut sheets resting on the conveyance path of FIG. 4 during the double-side print. The spacing L1 from the preceding cut sheet is 80 mm for Ai where the subsequent cut sheet results in the front side print. When the cut sheet is the sheet Ai for front side print, the sheet spacing L1 results in 58 mm. On the contrary, when the subsequent cut sheet is the double-side printed sheet Pi, the spacing L2 will be 130 mm which corresponds to one turn of the lower heat roller 50. Correspondingly, the respective cut sheets are arranged with L1 and L2 spacings.

Figure 9A:
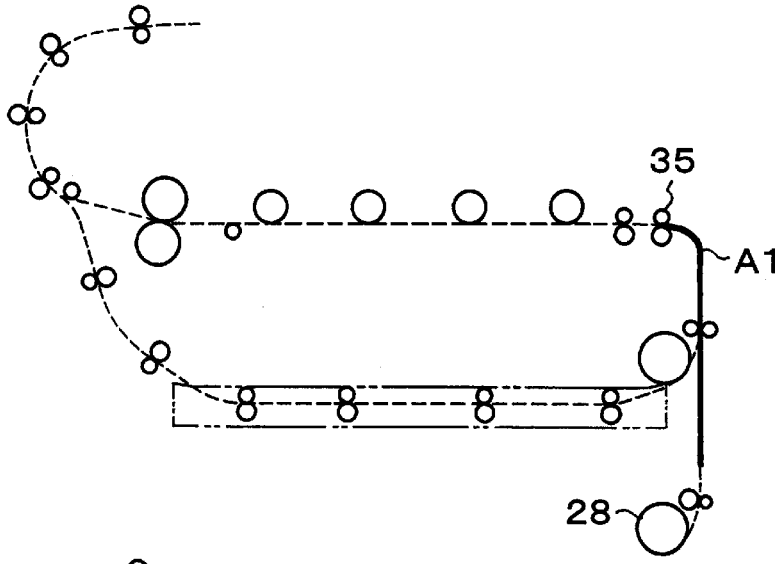
FIGS. 9A to 9L are explanatory diagrams of the cut sheet conveyance in case of double-side printing of 10 A4 cut sheets.
Figure 9B:
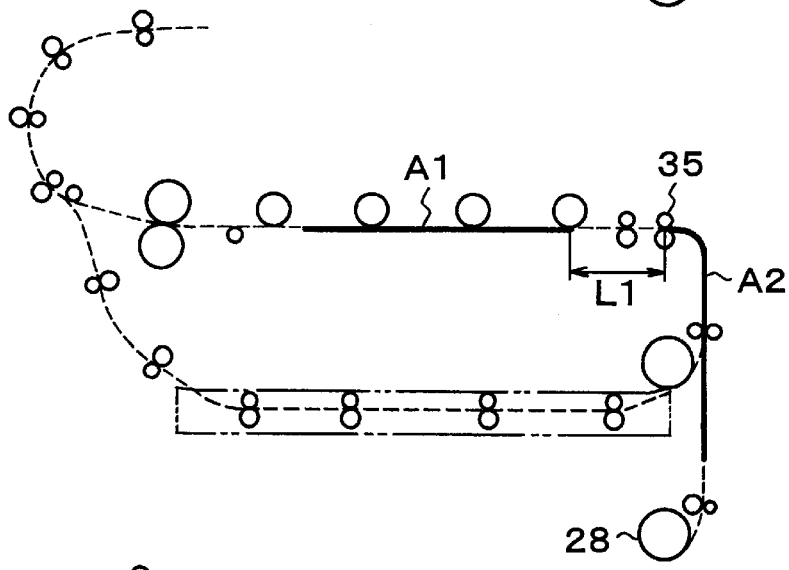
Figure 9C:
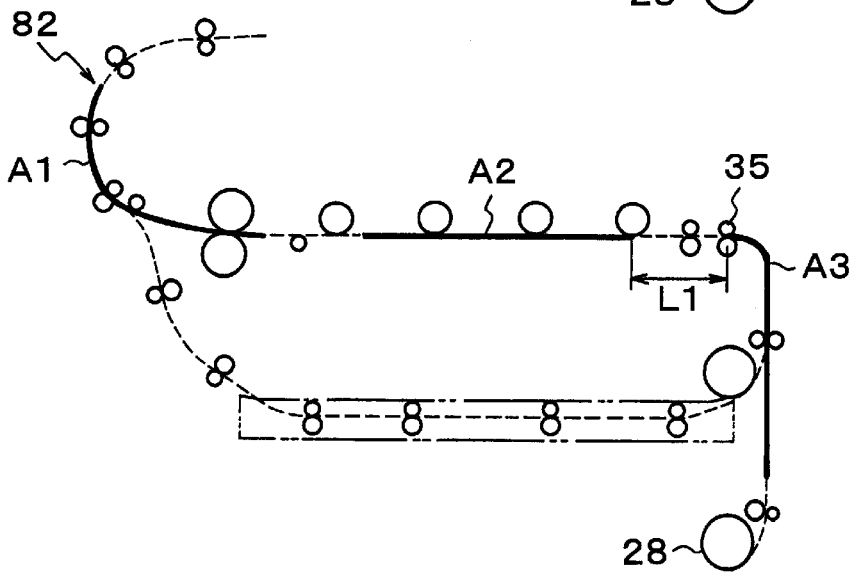
Figure 9D:
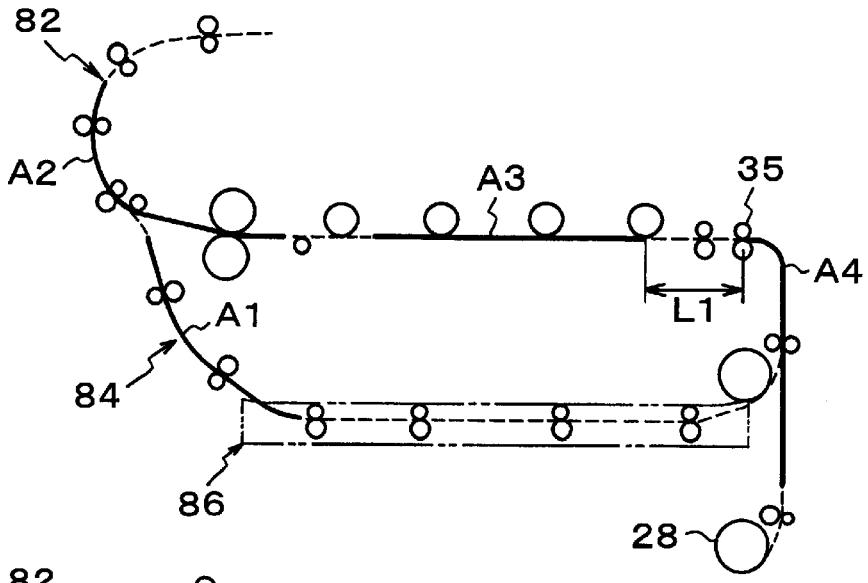
Figure 9E:
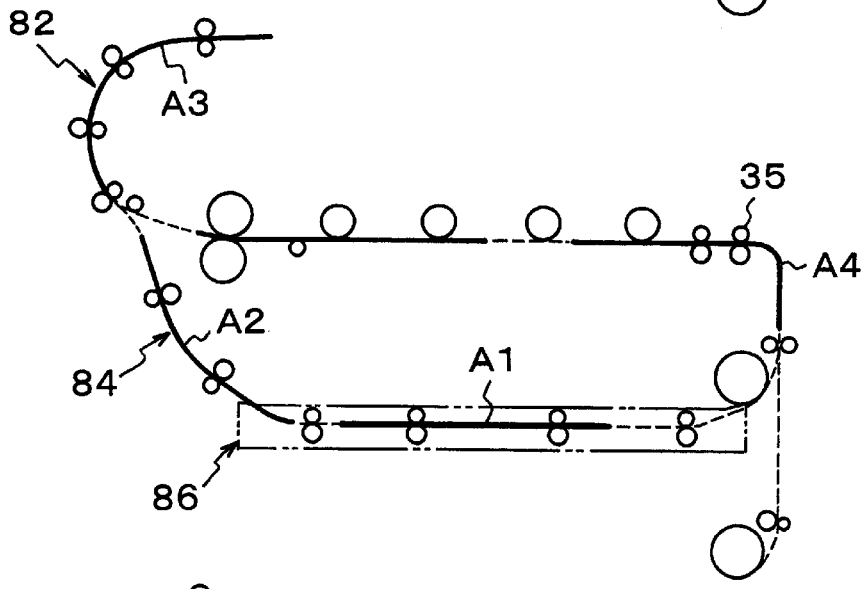
Figure 9F:
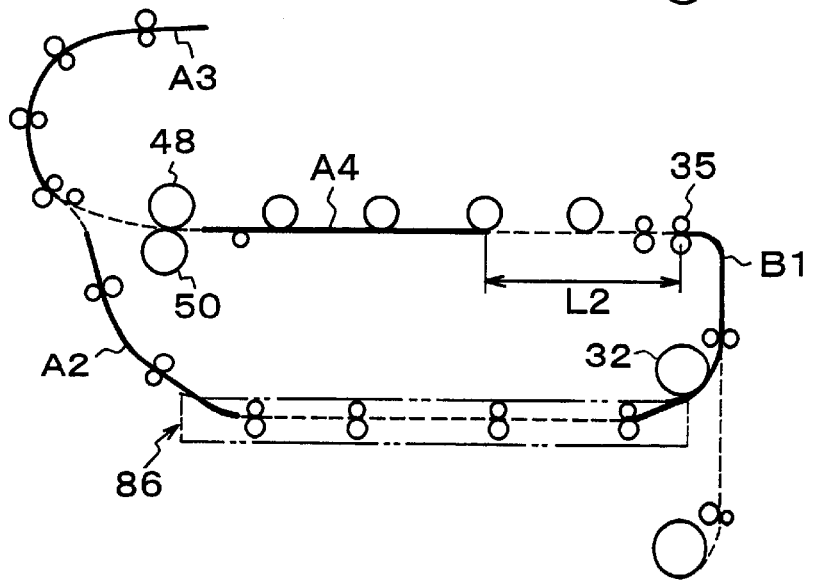
Figure 9G:
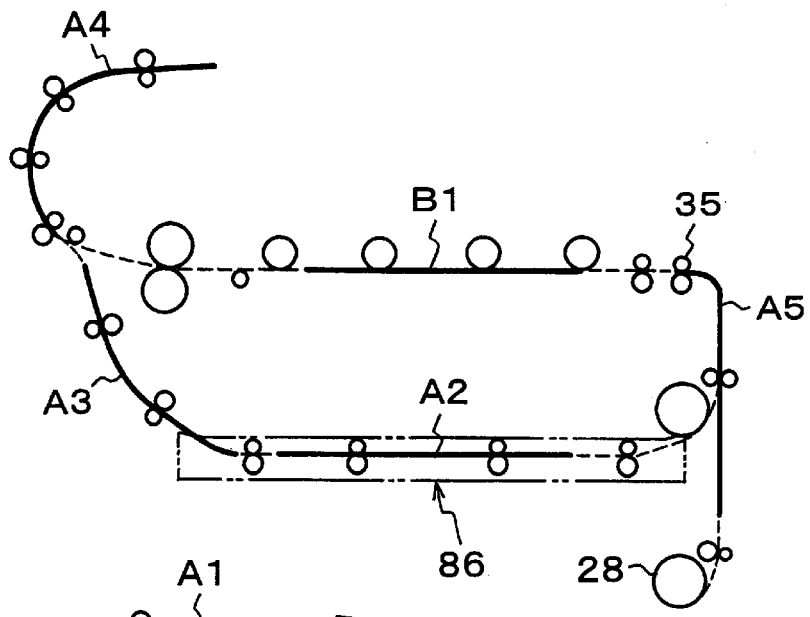
Figure 9H:
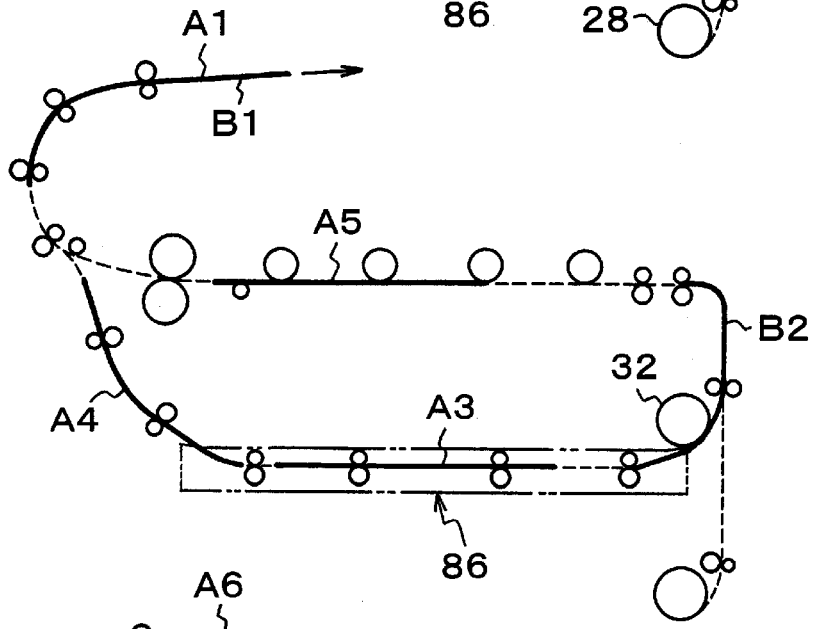
Figure 9I:
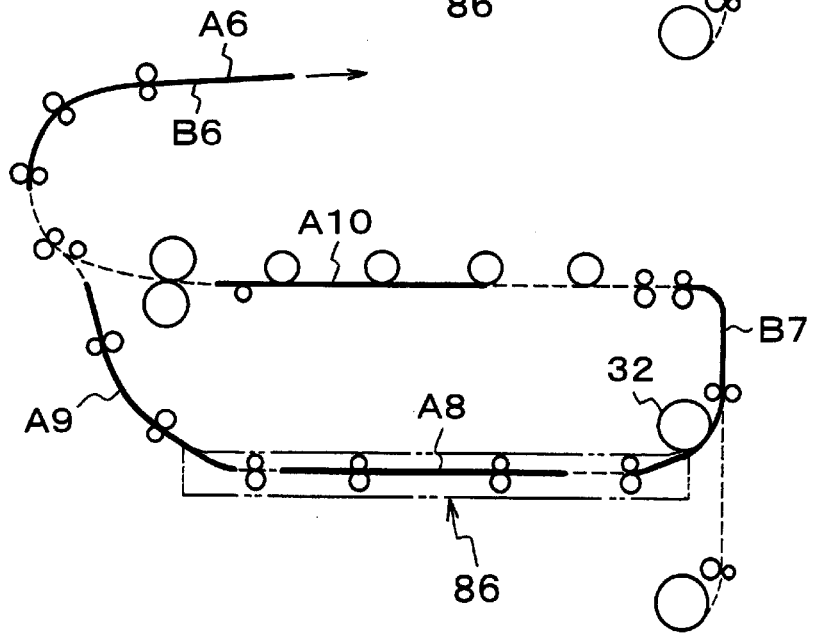
Figure 9J:
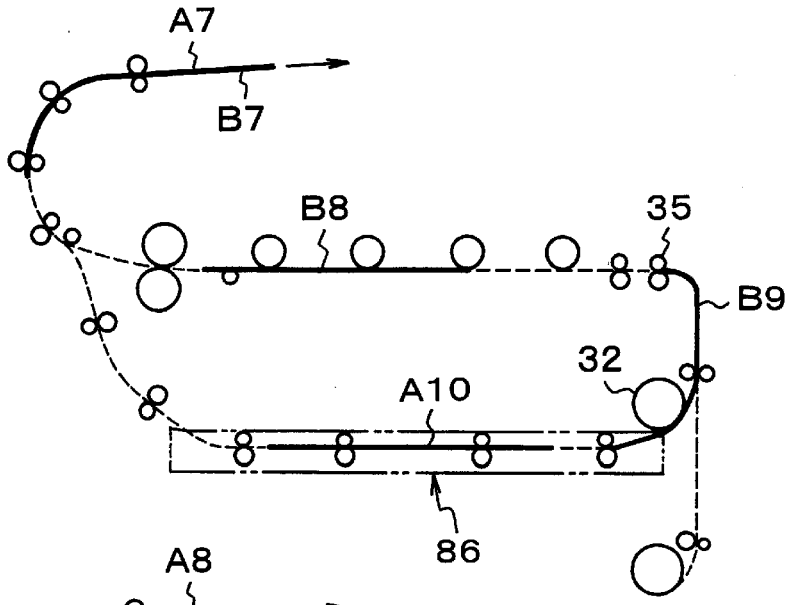
Figure 9K:
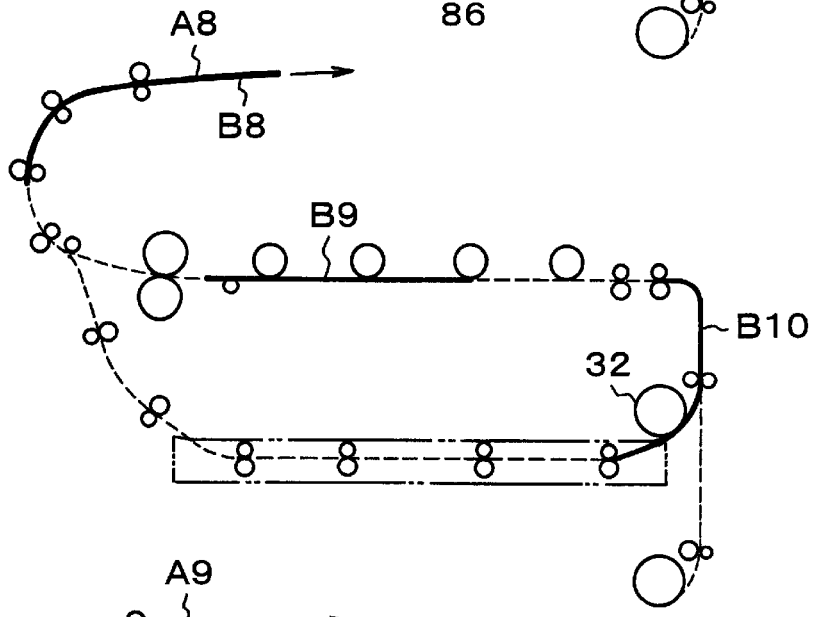
Figure 9L:
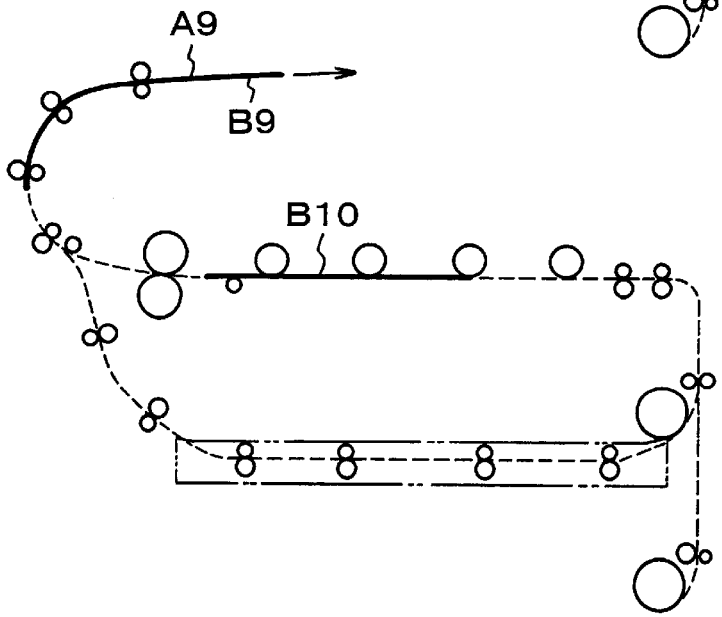

FIGS. 9A to 9L show in sequence the state of cut sheet conveyance in the double-side continuous printing of 10 A4 cut sheets of FIG. 8. FIG. 9A shows the state where a first surface print cut sheet A1 is picked up by the second pickup roller 28 for feed to the registration roller 35. After temporary stop at the registration roller 35, the surface print of the first cut sheet A1 is started as shown in FIG. 9B. When the trailing edge of the cut sheet passes through the registration roller 35 after the start of print of the cut sheet A1, a next cut sheet A2 is picked up by the second pickup roller 28, for temporary stop at the registration roller 35 as seen in FIG. 9B. Then, at the timing when the spacing from the preceding cut sheet A1 results in L1=58 mm, the registration roller 35 is activated to feed the second cut sheet for printing. Then, as seen in FIG. 9C, a third cut sheet A3 is picked up by the second pickup roller 28 and is temporarily stopped at the registration roller 35, the third cut sheet A3 being fed for printing with the spacing L1 from the preceding cut sheet A2. In mid-course where the cut sheet A3 is being fed for printing by the registration roller 35, the foremost front-side printed cut sheet A1 is fed to the first standby position 82 for temporary stop, after which the cut sheet A1 is reversely driven as seen in FIG. 9D for being fed to the second standby position 84 provided on the circulation loop. Then, when the third cut sheet A3 passes through the registration roller 35, a fourth cut sheet A4 is picked up by the pickup roller 28 and is temporarily stopped at the registration roller 35. Then, when the fourth cut sheet A4 is delivered by the registration roller 35 for the start of printing as seen in FIG. 9E, the cut sheet A1 circulated at the second standby position 84 in FIG. 9D is delivered to the third standby position 86 under the conditions that there is no cut sheet at the third standby position 86. As a result of this, the second standby position 84 becomes empty, so that the front-side printed cut sheet A2 is circulated as shown from the first standby position 82 to the second standby position 84, after which the front-side printed cut sheet A3 is positioned at the first standby position 82. After completion of the front-side printing of the fourth sheet in this manner, the cut sheet A1 at the third standby position 86 as in FIG. 9F is picked up by the first pickup roller 32 and is temporarily stopped at the registration roller 35 in the form of a cut sheet B1 for back-side printing. In the temporary stop state of the cut sheet B1 by the registration roller 35, the registration roller 35 is activated at the timing when the spacing from the cut sheet A4 reaches the distance L2=130 mm for one turn of the lower heat roller 50 provided on the fixing device, to start the delivery of the cut sheet B1 to the printing position. Then, due to the spacing L2 for one turn of the lower heat roller 50 between the preceding cut sheet A4 and the cut sheet B1 for double-side printing as seen in FIG. 9G, the upper heat roller 48 and the lower heat roller 50 rotate through one turn with their idle states during the time when the back-side printed cut sheet B1 reaches the fixing device 46 after the passage of the cut sheet A4 though the fixing device, whereby oil applied over the roller surface of the upper heat roller 48 can be applied over the roller surface of the lower heat roller 50. Since the back-side printed cut sheet B1 is allowed to enter the fixing device after the uniform application of oil over the roller surface of the lower heat roller 50 in this manner, the roller surface can carry an uniformly applied oil thereon in spite of possible melting of the underlying toner which forms the printed front-side images in contact with the lower heat roller 50. Thus, without any adhesion of the molten toner onto the roller surface, sufficient release property from the lower heat roller 50 can be secured due to the application of oil so that the double-side printed cut sheet B1 is smoothly discharged into the stacker as in FIG. 9H without subjecting the fixing device to any jamming after the double-side printing. During the back-side printing of the cut sheet B1 as seen in FIG. 9G, a fifth cut sheet A5 extracted from the cut sheet feed cassette by the second pickup roller 28 is temporarily stopped at the registration roller 35. Since the cut sheet A5 is to be front-side printed in this case, the registration roller 35 is activated at the timing when the spacing L1=58 mm lies from the preceding cut sheet B1, to perform the feed of the cut sheet A5 to its print position. After the completion of the feed of the cut sheet A5 to the print position, the cut sheet A2 at the third standby position 86 as in FIG. 9H is picked up by the first pickup roller 32 and is temporarily stopped by the registration roller 35, resulting in the cut sheet B2 for the second back-side printing. In this case, the registration roller 35 is activated at the timing when the spacing L2 from the preceding cut sheet A5 reaches 130 mm, similar to the case of the first back-side printing cut sheet B1 of FIG. 9F, to thereby feed the cut sheet B2 to its print position. Hereinafter, a sixth cut sheet A6 for front-side printing to a sixth cut sheet B6 for back-side printing are conveyed for double-side printing with the repetition of the same cut sheets as FIGS. 9F, 9G and 9H. Then, when a tenth cut sheet A10 for front-side printing is fed to its print position as in FIG. 9I, no new cut sheet for front-side printing is extracted from the cut sheet feed cassette, allowing four cut sheets B7, A8, A9, A10 remaining on the conveyance path to undergo the double-side printing only. That is, in case of the cut sheet B7 for back-side printing, the registration roller 35 is activated for feed to the print position for back-side printing when the spacing L2 from the preceding cut sheet A10 reaches 130 mm after the temporary stop by the registration roller 35. Similarly, the next cut sheet A8 is temporarily stopped at the registration roller 35 and thereafter is delivered to its print position with the spacing L2=130 mm from the preceding cut sheet. In FIG. 9J, a tenth cut sheet B9 is temporarily stopped by the first pickup roller 32 during the print of the eighth cut sheet B8 for back-side printing, and is delivered as in FIG. 9K with the spacing L2=130 mm. In the same manner, the tenth cut sheet B10 is temporarily stopped by the first pickup roller 32 and then delivered to its print position as in FIG. 9L with the spacing L2, thus completing the double-side print processing of 10 A4 cut sheets.

Figure 10A:
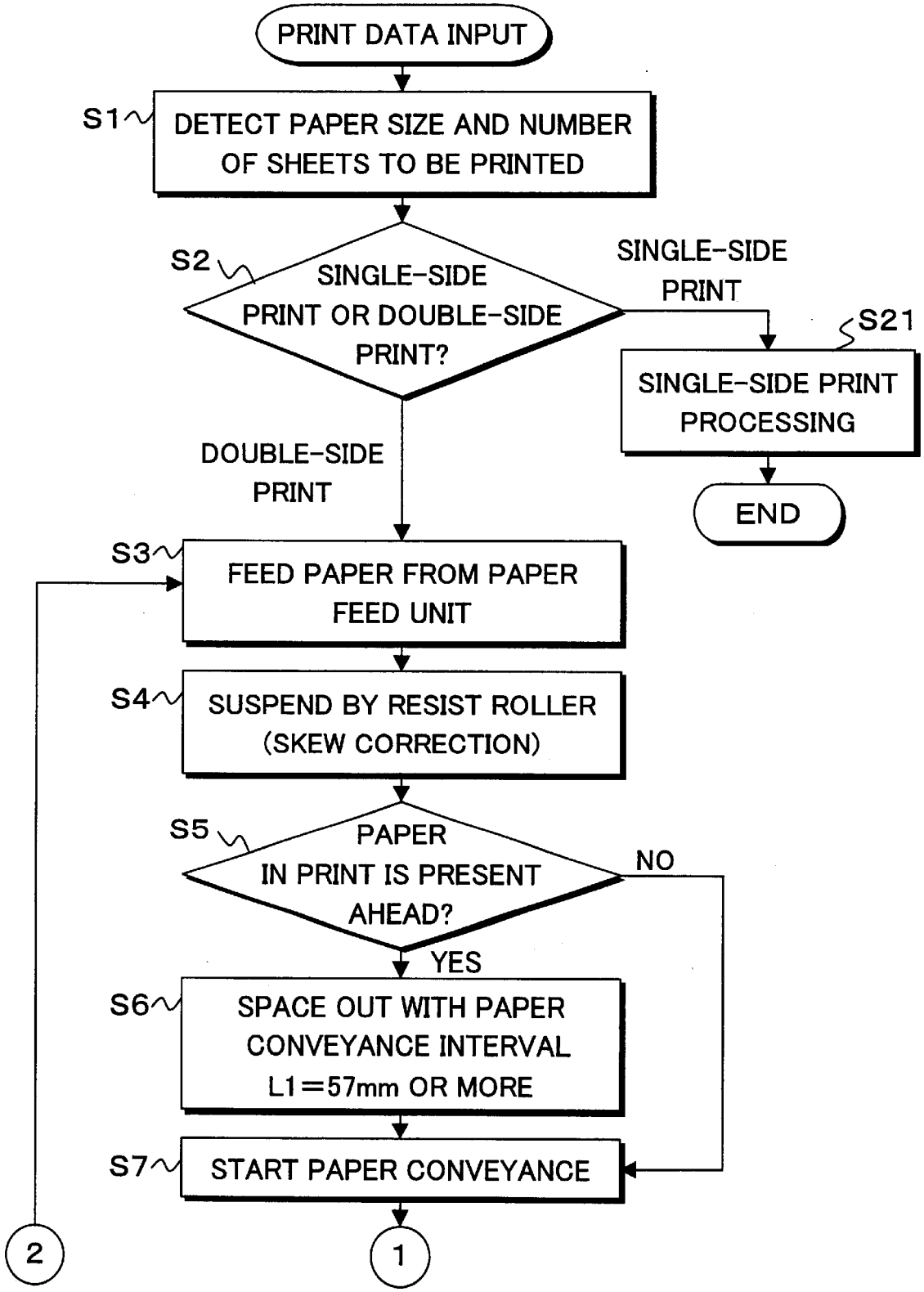
FIGS. 10A to 10C are flowcharts of the conveyance control upon the double-side printing in accordance with the present invention.
Figure 10B:
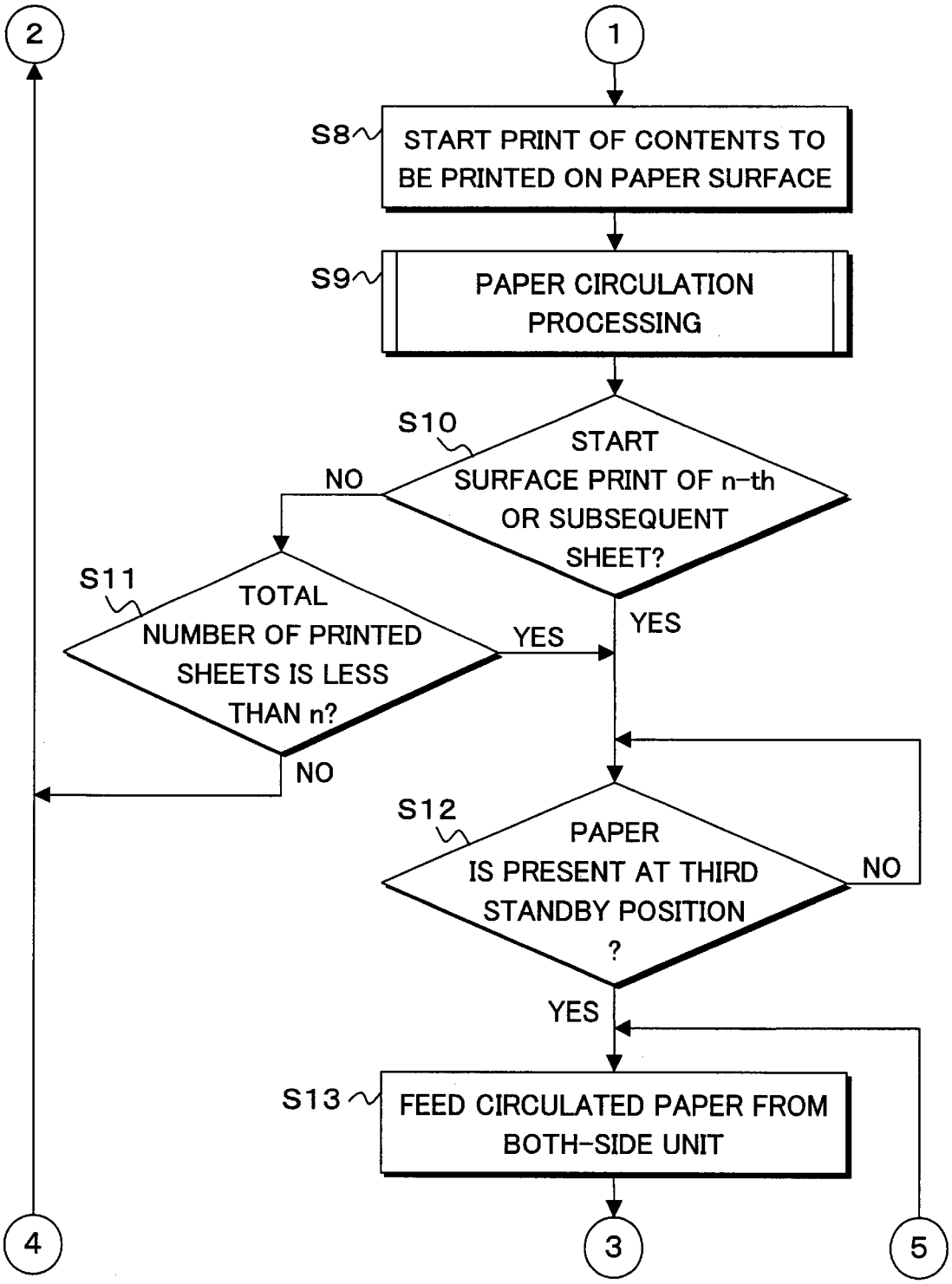
Figure 10C:
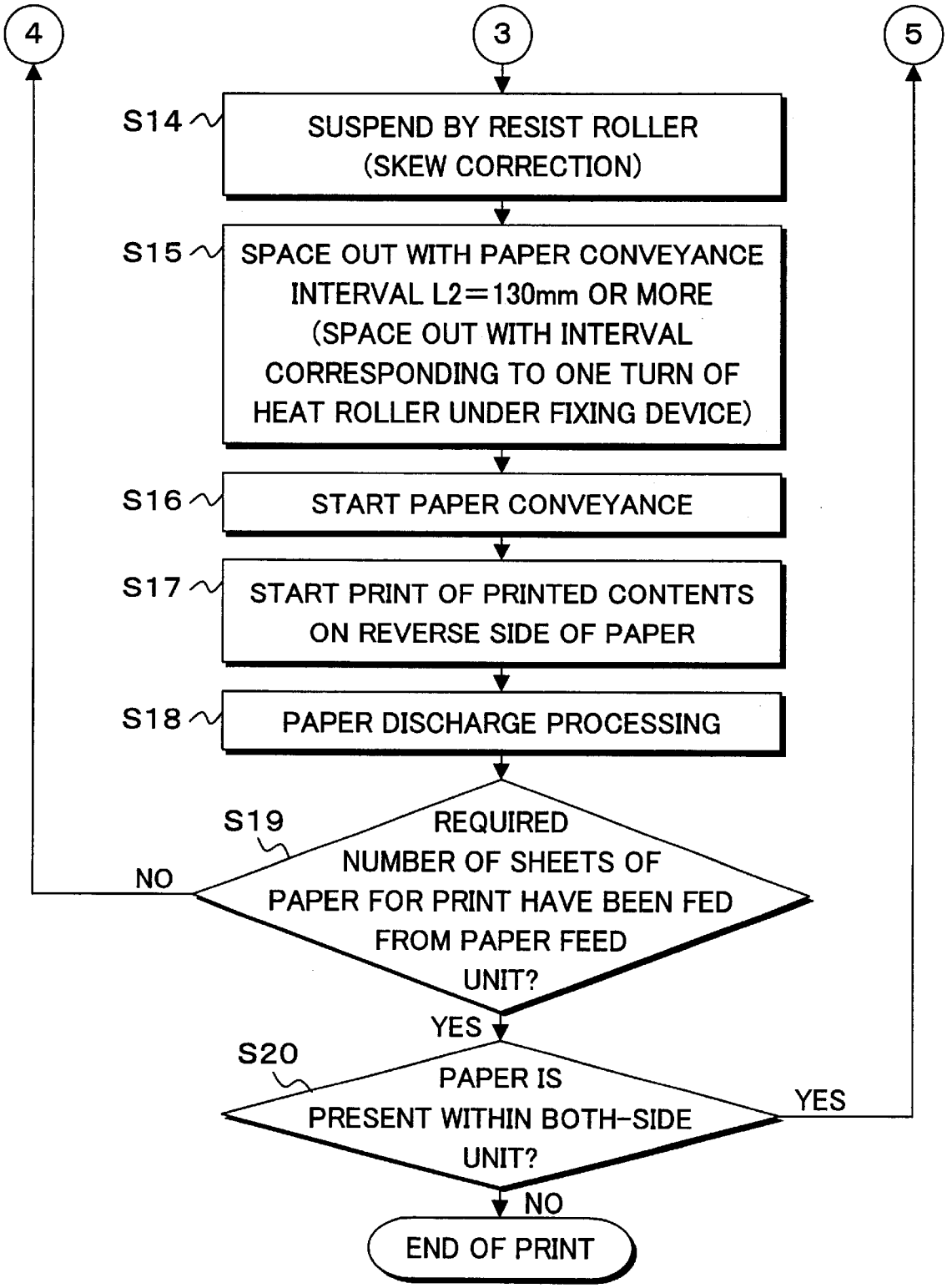

FIGS. 10A to 10C are flowcharts of control of the cut sheet printing and conveyance effected by the conveyance control unit 150 included in the mechanical controller 112 of FIG. 6. First, in step S1, detection is made of the control data such as paper size and the number of prints, and in step S2 it is judged whether it is the single-side print or the double-side print. If it is the single-side print, then the procedure goes to step S21 to terminate the single-side print processing. If it is the double-side print, then the procedure goes to step S3 to perform a cut sheet feed from the cut sheet feed unit such as the cut sheet feed cassette, and then to step S4 to make a temporary stop for the skew correction by the registration roller 35. It is then checked in step S5 to see if there is any cut sheet in print ahead, and due to the presence of the first one, the procedure goes to step S7 to start the conveyance of the cut sheets. For the second or subsequent ones, there exist preceding cut sheets in print, and hence the cut sheet conveyance is started in step S7 by the activation of the registration roller 35 with the cut sheet spacing L1=57 mm or more. Then in step S7, the printing of the contents of the cut sheet front-side print is started by the overlapping transfer of the toner images by the Y, M, C and K process units. Then in step S9, the circulation processing of the cut sheet paper is carried out.

Figure 11:
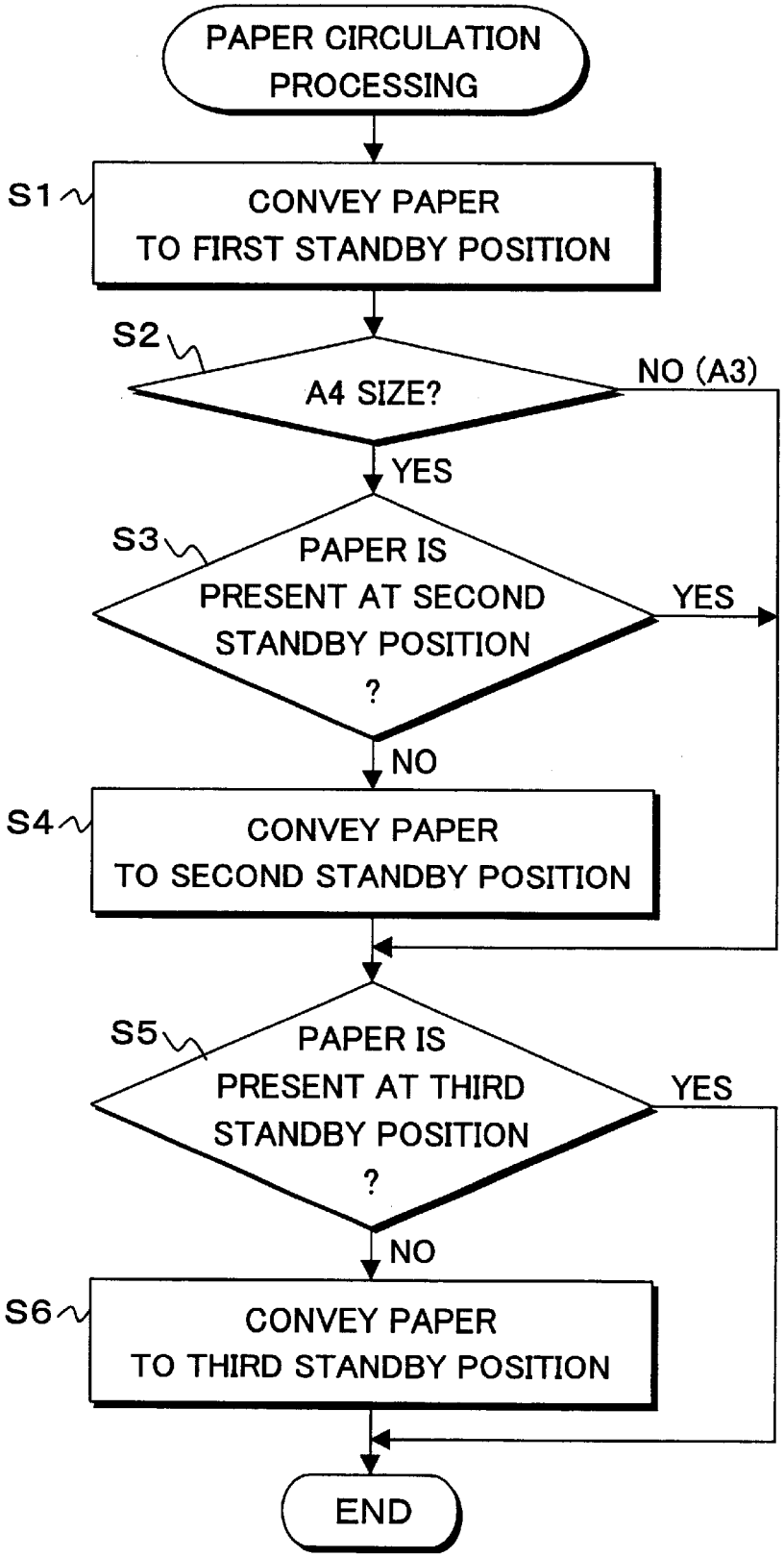
FIG. 11 is a flowchart showing the details of the cut sheet circulation processing of FIG. 10A.

The details of the cut sheet circulation processing are shown as a subroutine in FIG. 11. In the cut sheet circulation processing, a printed cut sheet is transferred to the first standby position 82 in step S1. It is checked in step S2 to see if the cut sheet is of A4 size or not, and if affirmative, then the procedure goes to step S3 to check whether there exist a cut sheet at the second standby position 84. If there exists no cut sheet, then a cut sheet is transferred to the second standby position 84 in step S4. It is then checked in step S5 to see if there exist a cut sheet at the third standby position 86, and if negative, then a cut sheet is transferred to the second standby position 84 in step S6.

Referring again to FIGS. 10A to 10C, after the completion of the cut sheet circulation processing in step S9, the procedure goes to step S10 to check whether the number of the front-side prints is set to the number of circulated sheets n determined by the paper size or more. In this embodiment, the number of circulated sheets n is 4 for the A4 cut sheet whilst the number of circulated sheets n is 2 for the A3 cut sheet. In case of the A4 cut sheet for example, a check is made of whether the front-side print of n=2 or more has been started, that is, whether the front-side prints has been made of the fourth or later cut sheets, and if negative, the procedure goes to step S10 to check whether the total number of prints detected in step S1 is less than the number of residual sheets. If the total number of prints is 3 for A4 size which is less than n=4 at that time, then the procedure migrates to the back-side printing which utilizes the circulation loop of the steps S12 or later of FIGS. 10A to 10C. If the total number of prints is not less than n=4, then the procedure goes back to step S3 to feed cut sheets from the cut sheet feed unit. If the start of the front-side printing is judged of the fourth sheet or later in step S10, then the procedure goes to step S12 to check whether there exists a cut sheet at the third standby position 86. If affirmative, then the procedure goes to step S13 to feed cut sheets for circulation from the double-side unit 20 at the third standby position 86, after which temporary stop for skew correction is made by the registration roller 35 in step S14. Then in step S15, the spacing L2=130 mm or more from the preceding cut sheet is formed which corresponds to one turn or more of the lower heat roller of the fixing device, and in step S16 the conveyance of the cut sheet is started by the activation of the registration roller 35. Then in step S14, the printing is started of the contents of the cut sheet back-side print. After the completion of the back-side print, the cut sheet discharge processing is carried out in step S18. It is then checked in step S19 whether the cut sheets have been fed from the cut sheet feed unit by the required number of sheets, and if negative, then the procedure goes back to step S3 of FIG. 10A, allowing the feed of cut sheets from the cut sheet feed unit, for repetition of the processings from the steps S4 to S19. If the required number of sheets has been fed in step S19, then the procedure goes to step S20 to check whether there exists a cut sheet within the double-side unit, i.e., at the third standby position 86. If affirmative, then the procedure goes back to step S13 to repeat the back-side printing by the cut sheet circulation from the double-side unit. If the cut sheet becomes absent at the third standby position within the double-side unit in this state, then the series of double-print processing is terminated.

Figure 12:
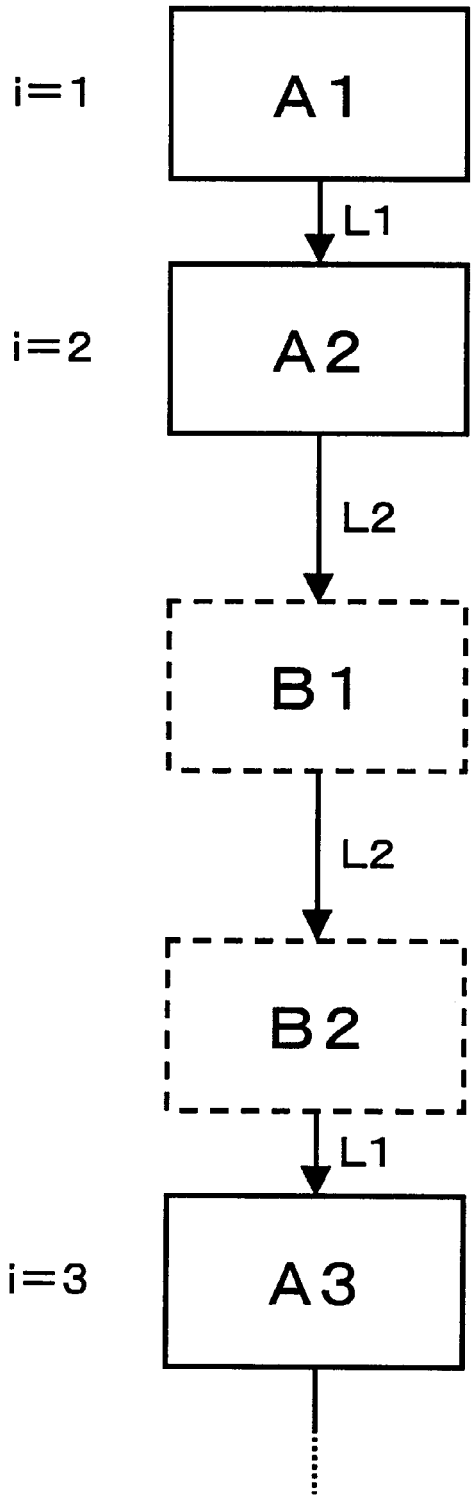
FIG. 12 is an explanatory diagram showing the order of the front-side printing and the back-side printing in case of continuous double-side printing of A3 cut sheets.

FIG. 12 shows, in the color printer of the present invention, the sequence of the front-side printing and the back-side printing in case of continuous double-side printing of A3 cut sheets. With the cut sheet size of A3, the number of circulated sheets n is 2 which is the number of sheets allowed to lie on the conveyance path. In this case, the first and second cut sheets A1 and A2 are first front-side printed, after which the back-side printing is made of the first and second ones, which process is iterated.

Figure 13A:
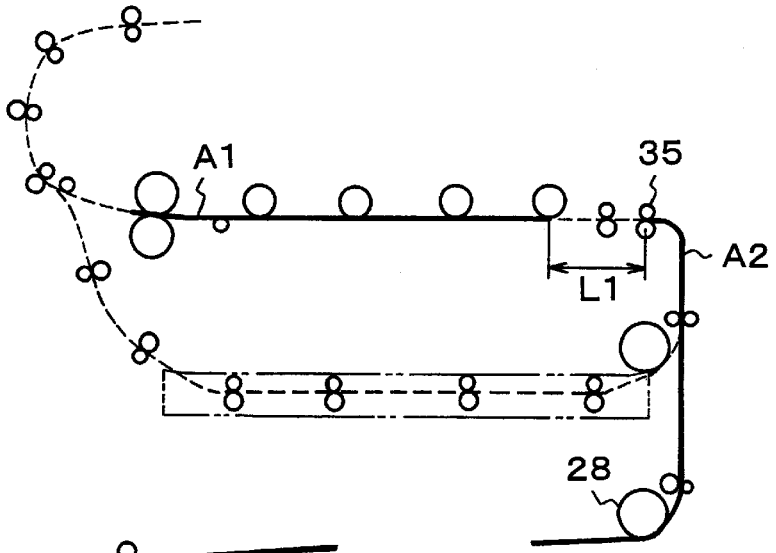
FIGS. 13A to 13H are explanatory diagrams of the cut sheet conveyance in case of continuous double-side printing of A3 cut sheets.
Figure 13B:
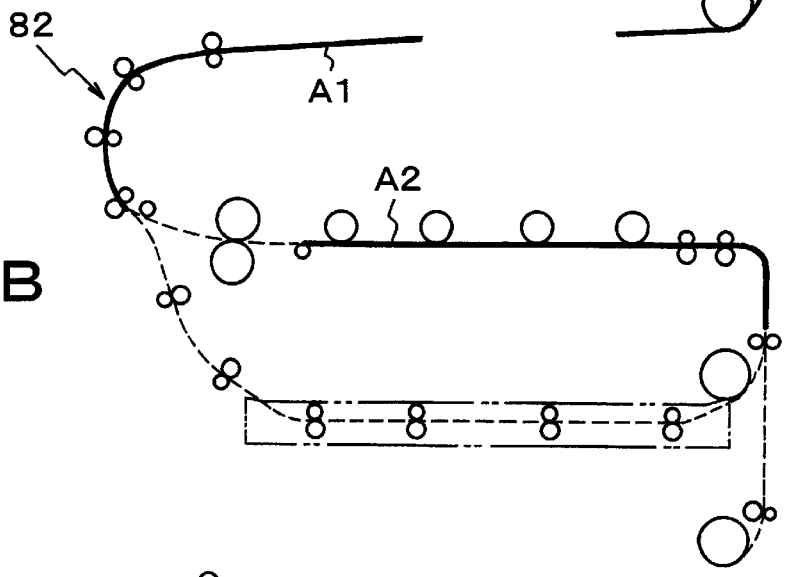
Figure 13C:
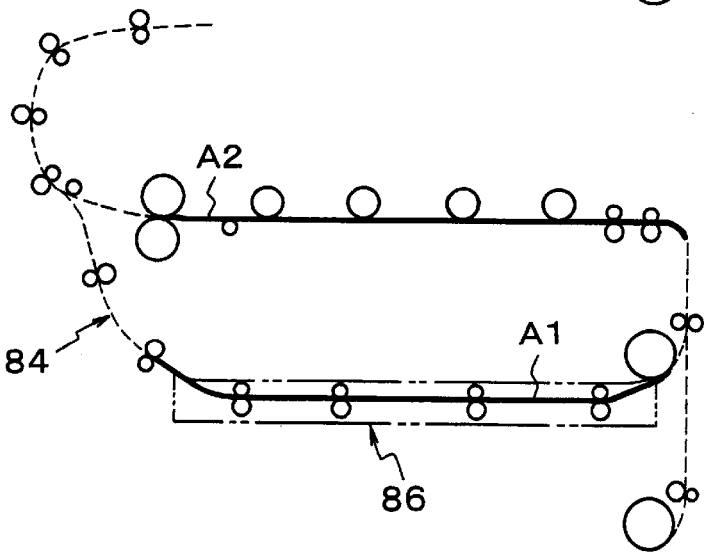
Figure 13D:
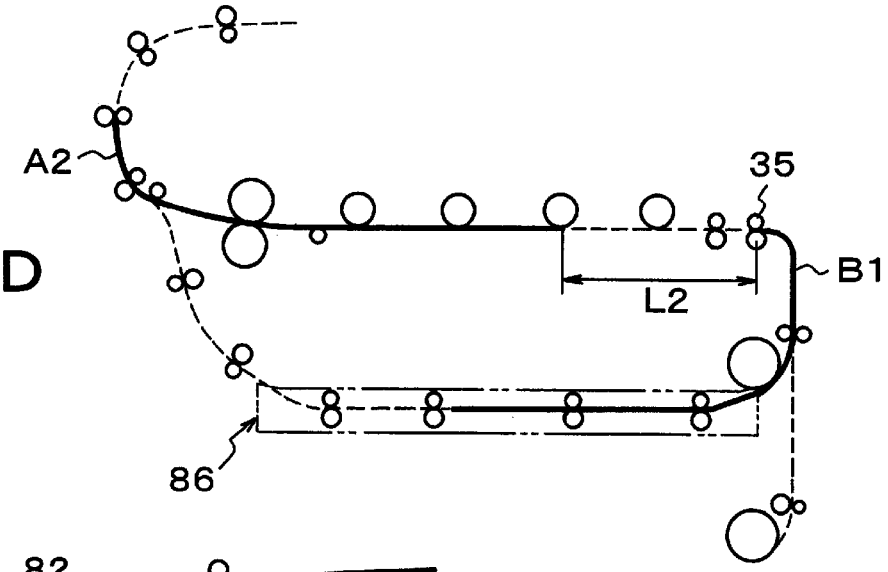
Figure 13E:
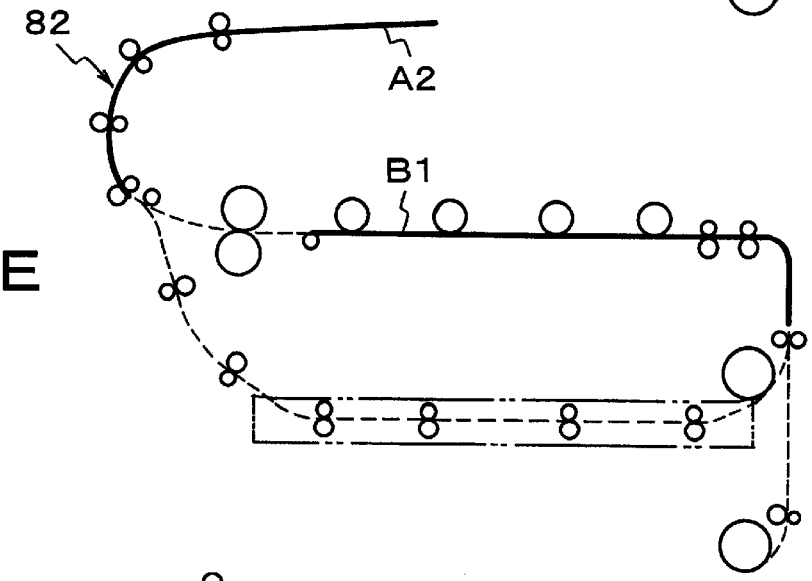
Figure 13F:
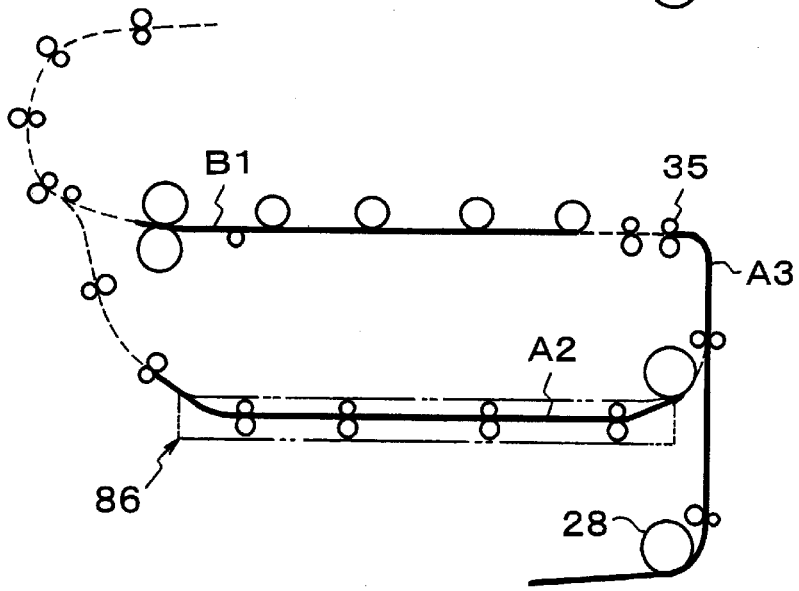
Figure 13G:
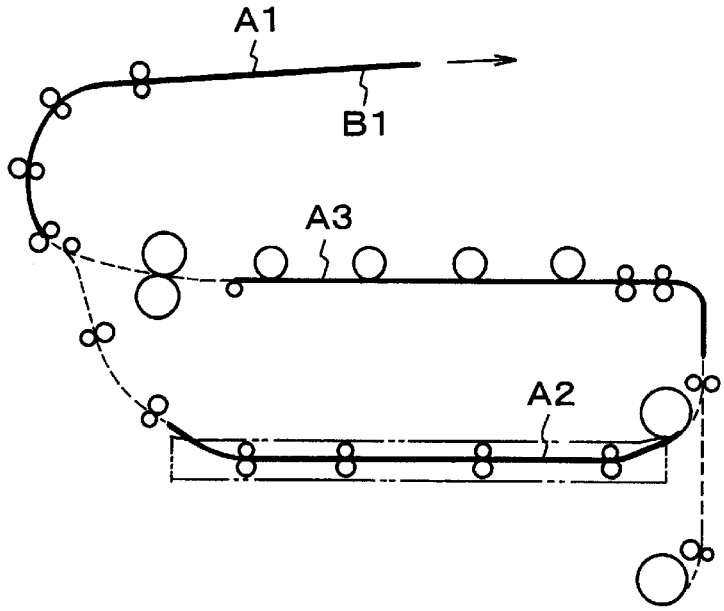
Figure 13H:
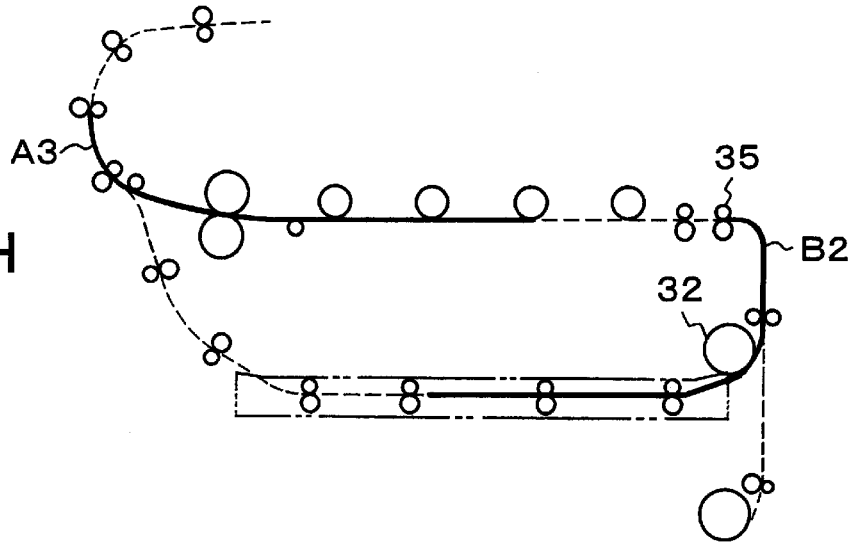

FIGS. 13A to 13H illustrate in sequence the conveyance of the cut sheets for double-side printing in the cut sheet size A3 of FIG. 12. In FIG. 13A, the second cut sheet A2 is fed and temporarily stopped by the registration roller 35 while the fed first cut sheet is in print, and with the spacing L2=57 mm from the cut sheet A1 in print, the second cut sheet A2 is fed by the registration roller 35 to the print position for the second cut sheet A2. In FIG. 13B, the second cut sheet A2 is in print, and at that time, the first cut sheet A1 is temporarily stopped at the first standby position 82. Then as seen in FIG. 13C, the first cut sheet A1 is conveyed via the second standby position 84 to the third standby position 86 of the double-side unit 20. Then as seen in FIG. 13D, the first cut sheet at the third standby position 86 of the double-side unit 20 is picked up as a cut sheet B1 for double-side printing and is temporarily stopped at the registration roller 35. When the spacing from the cut sheet A2 in print reaches the spacing L2 or more for one turn of the lower heat roller 50, the registration roller 25 is activated to feed the cut sheet to its print position. FIG. 13E shows the state where the first cut sheet B1 is being in back-side print. At that time, the second cut sheet A2 is at the first standby position 82 and then is circulated to the third standby position 86 as seen in FIG. 13F. In this state, a third cut sheet A3 is extracted from the cut sheet feed cassette and is temporarily stopped at the registration roller 35. Due to the front-side printing in this case, the registration roller 35 is activated with the spacing L1=57 mm from the cut sheet B1 in print, to convey the cut sheet A3 to its print position. FIG. 13G shows the third cut sheet A3 being in print, with the first back-side printed cut sheet B1 being discharged into the stacker. Subsequently, as seen in FIG. 13H, the second cut sheet B2 for back-side printing is extracted and temporarily stopped at the registration roller 35 during the print of the third cut sheet A3. When the spacing from the cut sheet A3 reaches L2=130 mm or more which corresponds to one turn of the lower heat roller 50, the second cut sheet B2 is conveyed to its print position for back-side printing by the first pickup roller 32. Subsequently, there alternate the cut sheet conveyance for the front-side printing from the cut sheet feed cassette and the cut sheet conveyance for the back-side printing from the double-side unit as in FIGS. 13F to 13H, and the last two cut sheets are continuously back-side printed.

According to the present invention, as set forth hereinabove, when performing the back-side printing after circulation of the front-side printed cut sheets, the cut sheet conveyance is carried out with the spacing between the adjacent two cut sheets which corresponds to at least one turn of the lower heat roller of the fixing device, whereby the upper and lower heat rollers can rotate through one turn in idle during the cut sheet spacing, with the idle rotation allowing the oil applied over the upper roller heater surface to be applied on the entire periphery. Thus, the upper and lower heater rollers can be supplied uniformly with oil whenever the back-side transferred front-side printed cut sheets enter the contact between the upper and lower heat rollers, whereby it is possible to securely prevent the paper jam attributable to the insufficient supply of oil to the lower heat roller and thereby to realize a stable cut sheet conveyance in the double-side printing operation.

By virtue of the structure of the fixing device used in which oil singly circulated to the oil roller is supplied from the upper heat roller through the roller contact to the entire periphery of the lower heat roller in spite of the double-side printing, an extremely simple fixing device structure will be suffice which is the same as that of the single-side printing where oil is supplied to only the upper heat roller, thus achieving a reduction in size and price of the fixing device for use in the double-side printing.

By virtue of its capability of stably supplying oil to the upper and lower heat roller from a single oil roller, there can be eliminated any deficiencies that an available oil roller has also to be replaced due to the shortage of oil in one roller, attributable to the uneven oil consumption as seen in the case where the oil supply station is provided for each roller, thus achieving a simple and easy replacement and management of the oil roller.

Although in the above embodiment as shown in FIG. 3 by way of example, the oil roller 52 is disposed on the side of the upper heat roller 48 of the fixing device 46 so that oil is applied from the upper heat roller 48 to the lower heat roller 50, the oil roller 52 may be provided on the side of the lower heat roller 50 so that oil is applied from the lower heat roller 50 to the upper heat roller 48. In this event, the spacing from the preceding cut sheet to be back-side printed should correspond to one turn or more of the upper heat roller.

Although the above embodiment has been directed to the one having the conveyance path adapted to maximize the throughput upon the double-side continuous printing of the A4 cut sheet by way of example, it is natural that the length of the conveyance path and the arrangement of the standby positions be determined so as to maximize the throughput for other paper size than A4. The present invention is intended to include any appropriate variants without impairing its objects and advantages and is not limited by numerical values indicated in the above embodiment.

What is claimed is:

1. An image forming apparatus capable of double-side printing, comprising a conveyance control unit which allows to cut sheet picked up from a cut sheet feed unit to be conveyed to a process unit for transfer of color images on a front side of said cut sheet, said front-side transferred color images being fixed by fixing device, said cut sheet switched back to a circulation path after fixing being reconveyed to said process unit for transfer of color images on a back side of said cut sheet, after which said back-side transferred color images are fixed by said fixing device for discharge, wherein said fixing device includes an upper heat roller and a lower heat roller which thermally fix images on a cut sheet passing therebetween, said fixing device including a single oil roller which supply oil for cut sheet release to said upper ad lower heat rollers, and wherein when conveying to said process unit a cut sheet to be back-side printed delivered via said circulation path, said conveyance control unit forms a conveyance spacing between said cut sheet to be back-side printed and a precedent cut sheet, said conveyance spacing conforming to one turn or more of said lower heat roller of said fixing device, wherein when the number of cut sheets i to be double-side printed is not more than the number of circulated cut sheets n which depends on the paper size and which is the maximum number of cut sheets permitted to lie on said conveyance path in the course of printing, said conveyance control unit provides a conveyance control to effect a continuous printing of back sides of cut sheets, following a continuous printing front sides of cut sheets.

2. The apparatus according to claim 1, wherein when the number of cut sheets i to be double-side printed exceeds the number of circulated cut sheets n which depends on the paper size, said conveyance control unit provides:

a conveyance control to effect a continuous printing of the front-sides of said cut sheets till the n-th cut sheet of i cut sheets;

a conveyance control of alternate the back-side printing of (i–n) th cut sheet and the front-side printing of i-th cut sheet until the number cut sheets i exceeds n and the number of remaining cut sheet reaches n; and when the number of circulated cut sheets is last n, a conveyance control to effect a continuous back-side printing of the remaining cut sheets.

3. The apparatus according to claim 2, wherein the number of circulated cut sheets n is 4 for paper size A4.

4. The apparatus according to claim 2, wherein the number of circulated cut sheets n is 2 for paper size A3.

5. The apparatus according to claim 1, wherein said conveyance control unit provides a drive control of a registration roller which temporarily stops a cut sheet to be conveyed to said process unit, for skew correction, to thereby form a conveyance spacing between a cut sheet to be back-side printed and a precedent cut sheet, the conveyance spacing conforming to one turn or more of said lower heat roller.

6. The apparatus according to claim 5, wherein said conveyance control unit provides a drive control of a registration roller which temporarily stops a cut sheet to be conveyed to said process unit, for skew correction, to thereby form a conveyance spacing between a cut sheet to be front-side printed and a precedent cut sheet, said conveyance spacing being shorter than the spacing which conforms to one turn or more of said lower heat roller.

7. The apparatus according to claim 1, wherein said fixing device comprises:

a fixing device body which encloses said upper heat roller and said lower heat roller; and an oil roller unit which encloses said oil roller, said oil roller unit being mountable on and dismountable from said fixing device body.

8. The apparatus according to claim 7, wherein said fixing device body includes a donor roller which intervenes between said oil roller and said upper heat roller, and wherein said oil roller unit includes a cleaning roller which cleans said donor roller.

9. A cut sheet conveyance control method in which a cut sheet picked up from a cut feed tray is conveyed to a process unit for transfer of color images on a front side of said cut sheet, said front-side transferred color images being fixed by a fixing device which includes an upper heat roller and a lower heat roller, said cut sheet switched back to a circulation path after fixing being reconveyed to said process unit for transfer of color images on a back side of said cut sheet, after which said back-side transferred color images are fixed by said fixing device for discharge, said method comprising the step of:

when conveying to said process unit a cut sheet to be back-side printed delivered via said circulation path, forming a conveyance spacing between said cut sheet to be back-side printed and a precedent cut sheet, said conveyance spacing conforming to one turn or more of said lower heat roller of said fixing device, wherein when the number of cut sheets i to be double-side printed is not more than the predetermined number of circulated cut sheets n which depends on the paper size and which is the maximum number of cut sheets permitted to lie on said conveyance path in the course of printing, a conveyance control is provided to effect a continuous printing of back sides of cut sheets, following a continuous printing of front sides of cut sheets.

10. The method according to claim 9, wherein when the number of cut sheets i to be double-side printed exceeds the number of circulated cut sheets n which depends on the paper size, control includes:

a conveyance control to effect a continuous printing of the front-sides of said cut sheets till the n-th cut sheet of i cut sheets;

a conveyance control to alternate the back-side printing of (i–n) th cut sheet and the front-side printing of i-th cut sheet until the number of cut sheets i exceeds n and the number of remaining cut sheets reaches n; and when the number of circulated cut sheets is last n, a conveyance control to effect a continuous back-side printing of remaining cut sheets.

11. The method according to claim 10, wherein the number of circulated cut sheets n is 4 for paper size A4.

12. The method according to claim 10, wherein the number of circulated cut sheets n is 2 for paper size A3.

13. The method according to claim 9, wherein through a drive control of a registration roller which temporarily stops a cut sheet to be conveyed to said process unit, for skew correction, a conveyance spacing is formed between a cut sheet to be back-side printed and a precedent cut sheet, the conveyance spacing conforming to one turn or more of said lower heat roller.

14. The method according to claim 9, wherein through a registration roller which temporarily stops a cut sheet to be conveyed to said process unit, for skew correction, a conveyance spacing is formed between a cut sheet to be front-side printed and a precedent cut sheet, said conveyance spacing being shorter than the spacing which conforms to one turn or more of said lower heat roller.

* * * * *